US011466534B2

(12) United States Patent
Slack et al.

(10) Patent No.: US 11,466,534 B2
(45) Date of Patent: Oct. 11, 2022

(54) CEMENTING HEAD APPARATUS

(71) Applicant: NOETIC TECHNOLOGIES INC., Edmonton (CA)

(72) Inventors: Maurice William Slack, Edmonton (CA); Petre Dorobantu, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 17/290,766

(22) PCT Filed: May 8, 2020

(86) PCT No.: PCT/CA2020/000060

§ 371 (c)(1),
(2) Date: May 2, 2021

(87) PCT Pub. No.: WO2020/223791

PCT Pub. Date: Nov. 12, 2020

(65) Prior Publication Data

US 2022/0003064 A1 Jan. 6, 2022

Related U.S. Application Data

(60) Provisional application No. 62/845,818, filed on May 9, 2019.

(51) Int. Cl.

| | |
|---|---|
| ***E21B 33/05*** | (2006.01) |
| ***E21B 33/13*** | (2006.01) |
| ***E21B 23/00*** | (2006.01) |

(52) U.S. Cl.
CPC ..... *E21B 33/05* (2013.01); *E21B 23/00* (2013.01); *E21B 33/13* (2013.01)

(58) Field of Classification Search
CPC ..... E21B 33/05; E21B 23/00; E21B 33/13
See application file for complete search history.

(56) References Cited

U.S. PATENT DOCUMENTS

| | | | |
|---|---|---|---|
| 1,750,143 | A | 3/1930 | Wickersham |
| 2,620,037 | A | 12/1952 | McClendon |

(Continued)

FOREIGN PATENT DOCUMENTS

| | | | |
|---|---|---|---|
| CA | 2038798 | A1 | 9/1991 |
| CA | 2818250 | C | 12/2014 |

(Continued)

OTHER PUBLICATIONS

International Search Report re PCT/CA2020/000060, issued by the ISA/CA dated Jul. 10, 2020.

(Continued)

*Primary Examiner* — Caroline N Butcher
(74) *Attorney, Agent, or Firm* — Donald V. Tomkins

(57) ABSTRACT

A cementing head apparatus includes a plug-launching tool and a tubular plug receiver cage disposed within a bore of the launching tool, plus one or more paddles selectively movable within a bore of the receiver cage between a hold position in which the paddles at least partially occlude the receiver cage bore to hold a plug within a retained plug interval of the receiver cage bore, and a launch position in which the paddles are substantially retracted from the receiver cage bore to allow passage of the plug through the receiver cage bore and onward into a casing string to which the launching tool is mounted. Upper and lower fluid bypass ports may be provided through the wall of the receiver cage, above and below the retained plug interval, to allow fluid flow within the receiver cage bore to bypass the retained plug interval via the receiver annulus

26 Claims, 27 Drawing Sheets

(56) References Cited

U.S. PATENT DOCUMENTS

| | | | | |
|---|---|---|---|---|
| 3,507,325 | A | 4/1970 | Scott | |
| 4,047,566 | A | 9/1977 | Duke | |
| 4,427,065 | A | 1/1984 | Watson | |
| 4,782,894 | A * | 11/1988 | LaFleur | E21B 33/16 166/70 |
| 5,435,390 | A | 7/1995 | Baugh et al. | |
| 5,833,002 | A | 11/1998 | Holcombe | |
| 8,636,067 | B2 | 1/2014 | Robichaux et al. | |
| 9,212,531 | B2 | 12/2015 | Robichaux et al. | |
| 9,500,060 | B2 | 11/2016 | Robichaux et al. | |
| 9,605,505 | B2 | 3/2017 | Robichaux et al. | |
| 2010/0200222 | A1 * | 8/2010 | Robichaux | E21B 33/068 166/250.01 |
| 2013/0161005 | A1 | 6/2013 | Yates et al. | |
| 2014/0360720 | A1 | 12/2014 | Corbeil | |
| 2017/0370169 | A1 * | 12/2017 | Genovese | E21B 33/12 |

FOREIGN PATENT DOCUMENTS

| | | | |
|---|---|---|---|
| CA | 2975946 | A1 | 12/2014 |
| WO | 2018005683 | A1 | 1/2018 |

OTHER PUBLICATIONS

Written Opinion of the International Searching Authority re PCT/CA2020/000060, completed by the ISA/CA on Jul. 8, 2020, and issued by the ISA/CA dated Jul. 10, 2020.

International Preliminary Report on Patentability (Chapter II) re PCT/CA2020/000060, issued by the International Preliminary Examining Authority dated Apr. 15, 2021.

* cited by examiner

CEMENTING HEAD APPARATUS

FIELD

The present disclosure relates in general to apparatus for launching wiper plugs, wiper darts, balls or other articles during cementing or stimulation operations of oil, gas, water, or other wells.

BACKGROUND

It is well known to form a well (such as an oil, gas, or water well) by using a drilling rig to rotate a bit attached to the end of a string of drill pipe such that the bit advances through subterranean soil formations to form a wellbore of desired length and orientation. It is common practice to run a string of casing pipe into the wellbore, leaving an annulus between the casing string and the wellbore, and then to introduce a cement slurry into at least a portion of the wellbore annulus. This is commonly called a cementing operation.

Cementing operations can be carried out in several different ways, but one common procedure involves introducing a first (or "lower") wiper plug into the upper end of the casing string, and then pumping a selected quantity of cement slurry into the casing, displacing the lower wiper plug downward within the casing. A second (or "upper") wiper plug is then inserted into the upper end of the casing string, after which a suitable fluid (for example, a drilling fluid) is pumped into the casing and displaces the upper wiper plug, the wet cement slurry, and the lower wiper plug downward within the casing string, such that the slurry is forced out the lower end of the casing and upward into the wellbore annulus. Due to fluid density differences, the cement slurry flowing upward into the wellbore annulus will displace any drilling fluid or other fluid present in the annulus. This process is continued until the cement slurry has reached a desired level in the annulus.

The upper and lower wiper plugs provide positive separation between the cement slurry and the other wellbore fluids. The lower wiper plug is typically configured such that its downward movement within the casing string will be to be stopped by a "cement shoe" provided at the lower end of the casing. The lower wiper plug has a center bore that is initially closed off by a "burst disk" that will fail (i.e., burst) at a selected differential pressure, thus allowing the cement slurry to flow through the lower wiper plug and out the bottom of the casing and up the wellbore annulus. The upper wiper plug similarly has a center bore that is initially closed by a burst disk, but with a burst pressure higher than the burst pressure of the lower wiper plug.

A cementing head (of which there are numerous known types) is used to connect the upper end of the casing string to flow lines from the drilling rig through which cement slurry and other fluids can be pumped into the casing. Additionally, state-of-the-art cementing heads provide a structural connection between the drilling rig and the casing string to transfer both vertical hoisting loads and torsional loads into the casing string as necessary during so-called "hoist, reciprocate, and rotate" manipulations of the casing string, which are used to promote optimally effective displacement of fluids by the cement slurry, and to promote optimally uniform distribution of the slurry within the cemented region of the wellbore annulus. Thus, these cementing heads must facilitate the transfer of cement slurry and fluids to the rotating casing string from the non-rotating drilling rig flow lines.

The cementing head also must accommodate the introduction of the wiper plugs into the casing bore (or "dropping a plug", as this procedure is commonly called). In accordance with one simple method, this can be achieved by disconnecting the cementing head from the upper end of the casing string and manually inserting the wiper plug. However, this simple method is feasible only where the cementing procedure being used will permit temporary stoppage of fluid flow such that the pressure at the cementing head will not exceed atmospheric pressure when the plug is dropped. Moreover, any advantages arising from the simplicity of this method of dropping a plug will typically be offset by the additional time and labor required to disconnect and reconnect the cementing head, plus the added risks of environmental damage and injuries to workers in the event of accidental and uncontained fluid spillage.

To avoid such disadvantages and risks, it is common for "plug launchers" to be incorporated into cementing heads. Plug launchers facilitate the introduction of wiper plugs and other accessory articles familiar to persons skilled in the art (e.g., wiper darts or balls) into the flow path of fluids within the casing bore without needing to disconnect the cementing head or associated flow lines. As used in this patent specification, the term "plug" is to be understood as a general term encompassing articles and devices (such as but not limited to wiper plugs, wiper darts, and balls) that may be introduced into a fluid flow path within a tubing string (such as but not limited to a casing bore), unless the context clearly requires otherwise.

A plug launcher will typically contain a plug within the pressured envelope of the cementing head assembly, with means being provided for retaining the plug (such as by way of suitable latching means) when the plug launcher is in a hold position, and for releasing (i.e., "launching" or "dropping") the plug when the plug launcher is in a launch position. When the plug launcher is in the hold position, flowing fluid can bypass the plug and enter the casing string bore as required by the cementing operation in preparation for dropping a plug. After the plug launcher has been moved to the launch position, the continued pumping of fluid into the casing will force the plug into the bore of the casing string.

Examples of known cementing heads are disclosed in the following prior art patent documents:

- U.S. Pat. No. 2,620,037 (McClendon);
- U.S. Pat. No. 3,076,509 (Burns);
- U.S. Pat. No. 3,971,436 (Lee);
- U.S. Pat. No. 4,246,967 (Harris);
- U.S. Pat. No. 4,317,486 (Harris);
- U.S. Pat. No. 4,671,353 (Darning);
- U.S. Pat. No. 4,917,184 (Freeman);
- U.S. Pat. No. 4,995,457 (Baldridge);
- U.S. Pat. No. 5,236,035 (Brisco);
- U.S. Pat. No. 5,293,933 (Brisco);
- U.S. Pat. No. 6,517,125 (Brisco);
- U.S. Pat. No. 6,575,238 (Yokley);
- U.S. Pat. No. 6,672,384 (Pedersen);
- U.S. Pat. No. 6,715,541 (Pedersen);
- U.S. Pat. No. 6,776,228 (Pedersen);
- U.S. Pat. No. 7,055,611 (Pedersen);
- U.S. Pat. No. 7,066,249 (Simson);
- U.S. Pat. No. 7,325,610 (Giroux);
- U.S. Pat. No. 8,256,515 (Barbee);
- U.S. Pat. No. 8,668,003 (Osmundsen);
- U.S. Pat. No. 9,605,505 (Robichaux);
- U.S. Patent Application Pub. No. US 2017/0370169 (Genovese et al.); and International Pub. No. WO 2017/173522 (Slack).

It is known for plug launchers in cementing heads to provide for a flag or release indicator disposed downstream of the location where a plug was initially retained (i.e., when the plug launcher was in the hold position), to facilitate the determination or confirmation that the plug was in fact introduced into the fluid flow path after the plug launcher was moved to the launch position. The desirability of such release indicators has arisen at least in part from inadequate reliability of known plug launchers in which the means for selectively retaining or releasing a plug typically uses some form of flow control valve (such as a gate valve or ball valve). Additionally, such prior art plug-launching devices tend to have bulky valve actuation assemblies protruding radially outward from the plug launcher body, thus creating additional safety hazards when the plug launcher is rotated with the casing string during cementing operations.

For plug launchers that use a ball-type flow control valve (such as plug launchers disclosed in U.S. Pat. Nos. 3,076,509, 4,317,486, and 8,256,515), the diameter of the valve ball must be substantially larger than the valve bore diameter in order to fully close the bore when the ball valve is in the closed position. Specifically, the diameter of the valve ball, $r_{ball}$, in relation to the diameter of the valve bore, $r_{bare}$, must satisfy the following requirement:

$$r_{bali}24\sqrt{2}r_{bore}$$

This requirement effectively establishes the minimum size of the plug launcher, and may result in the plug launcher being undesirably large and heavy.

BRIEF SUMMARY

The present disclosure teaches embodiments of cementing head apparatus comprising a plug-launching tool that uses one or more rotatable shafts each of which carries one or more paddle elements arranged to retain a plug within a fluid flow path through the plug launcher when the plug launcher is in a hold position, and to release the plug into the fluid flow path when the plug launcher is in a launch position. Selection of the desired operational position of the plug launcher (i.e., hold or launch) is effected by rotating the rotatable shafts.

Embodiments of cementing head apparatus in accordance with the present disclosure may also incorporate cement swivel tools that connect the non-rotating flow lines from the drilling rig to the rotating portion of the cementing head that engages with the casing string.

Embodiment to Hold and Launch Wiper Plugs or Darts

In a basic embodiment in accordance with the present disclosure, the cementing head apparatus includes a plug launcher comprising:

- an axisymmetric plug launcher housing ("launcher housing") having upper and lower ends, a launcher housing bore, a launcher housing wall, and a longitudinal axis (or "launcher housing axis") wherein the launcher housing bore is sized to accommodate a selected plug, to allow downstream passage of the plug under "flow conditions"—which for purposes of this patent documents means conditions during which a fluid is flowing (typically downward) through the launcher bore, and to allow fluid to flow around (i.e., bypass) the plug when the plug launcher is in the hold position;
- one or more rotatable shafts ("paddle shafts") extending through openings in the launcher housing and into openings in the receiver bore, wherein the paddle shafts have rotational axes ("paddle shaft axes") that are perpendicular to, but transversely offset from, the launcher housing axis (i.e., the paddle shaft axes do not intersect the launcher housing axis);
- one or more paddle elements ("paddles") coupled to the one or more paddle shafts so as to be movable between a closed (or "hold") position and an open (or "launch") position by selective rotation of the paddle shafts, and wherein the paddles are configured:
  - to retain a plug within a receiver bore fluid flow path, when the paddles are in the hold position; and
  - to release the plug into the receiver bore fluid flow path, when the paddles are in the launch position; and
- actuation means, for rotating the paddle shafts to move the paddles between the hold and launch positions.

In a variant of the basic embodiment described above, the plug launcher further comprises a generally a generally tubular plug receiver cage ("receiver cage") having upper and lower ends, a plug receiver cage bore ("receiver bore"), and a receiver cage wall, wherein:

- the receiver cage is disposed within the launcher housing bore;
- the receiver bore extends through the receiver cage and thus is coextensive with a portion of the launcher housing bore;
- the receiver bore defines a retained plug interval for receiving and releasably retaining a selected plug; and
- the receiver bore is sized to allow passage of the selected plug downstream of the retained plug interval;

Embodiment to Hold and Launch Wiper Plugs or Darts, and to Control Bypass Fluid Flow In another embodiment in accordance with the present disclosure, the plug launcher facilitates annular bypass flow when in the hold position, and also facilitates selective restriction of annular bypass flow when in the launch position. This particular embodiment of the cementing head apparatus includes a plug launcher comprising:

- an axisymmetric launcher housing having upper and lower ends, a launcher housing bore, a launcher housing wall, and a launcher housing axis;
- a generally tubular plug receiver cage ("receiver cage") having upper and lower ends, a plug receiver cage bore ("receiver bore"), and a receiver cage wall, wherein:
  - the receiver cage is disposed within the launcher housing bore (preferably but not necessarily coaxially);
  - the receiver launcher housing bore axially supports the receiver cage at the upper and/or lower ends thereof, with an annular region (alternatively referred to herein as a "receiver annulus") being formed between the launcher housing and the receiver cage;
  - the receiver bore is sized to accommodate a selected plug, and to allow downstream passage of the plug under "flow conditions"; and
  - the receiver cage has one or more upper receiver cage ports and one or more lower receiver cage ports extending through the receiver cage wall, leaving an unported receiver cage interval between the upper and lower receiver cage ports, and with the unported interval defining a retained plug interval within a medial region of the receiver cage, with the length of the retained plug interval being selected to be at least approximately equal to the length of the selected plug, and with the receiver cage ports enabling annular bypass flow into and out of the receiver annulus;
- one or more rotatable shafts ("paddle shafts") extending through openings in the launcher housing wall and the receiver cage wall, wherein the rotational axes of the paddle shafts ("paddle shaft axes") are perpendicular to, but transversely offset from, the launcher housing axis;

one or more paddle elements ("paddles") coupled to the one or more paddle shafts so as to be movable between a hold position and a launch position by selective rotation of the one or more paddle shafts, wherein the paddles are configured:

to retain a plug within a receiver bore fluid flow path and to allow substantially unrestricted bypass fluid flow (via the receiver annulus), when the plug launcher is in the hold position ("unrestricted bypass flow" in this context means flow that does not generate significant pressure drop"); and to release the plug into the receiver bore fluid flow path and to substantially or fully restrict annular bypass fluid flow, when the plug launcher is in the launch position;

such that movement of the paddles from the hold position to the launch position will tend to allow the plug to move in the downstream direction, and will progressively restrict bypass fluid flow; and actuation means, for rotating the paddle shafts to move the paddles between the hold and launch positions.

When the paddles are in the hold position, with a plug retained within the retained plug interval, the receiver bore is effectively blocked off. In this configuration, however, the receiver cage ports above (i.e., upstream of) and below (i.e., downstream of) the retained plug interval are in fluid communication with the receiver annulus, thus enabling fluid flow bypassing the blocked-off receiver bore and into the wellbore as may be necessary or desired prior to launching the plug.

It is desirable for plug launchers to be capable of launching of plugs during flow conditions. However, in prior art devices that provide annular bypass flow closure (such as in U.S. Pat. No. 8,256,515), an open position of the associated flow control valve that is effective to release the plug is possible only when annular bypass flow is at least substantially prevented. When attempting to release a plug under flow conditions, this operational limitation tends to result in excess differential pressure across the plug prior to the valve being moved into a position that releases the plug, with the attendant risks of premature rupture of the plug burst disk (a plug component familiar to persons skilled in the art) and damage to the plug body, thereby affecting the plug's ability to wipe effectively, or causing it to jam in the plug launcher.

Plug launcher embodiments in accordance with the present disclosure mitigate or eliminate these limitations and risks, because as the paddles are moved toward the launch position, they will progressively restrict the bypass flow through the lower receiver cage ports while simultaneously permitting progressive displacement of the plug in the direction of the flowing fluid. Accordingly, the paddles substantially restrict bypass flow only when the paddles are fully retracted from the receiver bore. In this fully retracted position, the paddles form part of the receiver bore wall, with the associated lower cage ports being close-fitting around each paddle. Sealing elements may be placed on the receiver cage or on the paddles to effect fluid sealing when the paddles are fully retracted.

This substantially provides for flow path overlap when the paddles are moving between hold and launch positions—i.e., allowing some open-bore flow in conjunction with plug displacement before bypass flow is closed off, thus minimizing the risk of excess differential pressure across the plug. This arrangement thus facilitates reliable plug launching under a range of flow conditions without the operational limitations of prior art devices that either require flow stoppage or limited flow in order to protect the plug where bypass flow restriction is provided, or that require relatively high flow rates in order to reliably displace the plug when little or no bypass flow restriction is provided.

Embodiment With Paddles Configured to Occlude the Plug Receiver Cage Bore

In an embodiment particularly suited to dropping multiple balls such as so-called "frac balls" typically ranging in size down to 1 or 2 mm, the plug launcher can be configured to occlude the receiver cage bore sufficiently to retain such objects, and facilitates annular bypass flow when in the hold position. When in the launch position, the plug launcher does not restrict the receiver bore, and facilitates selective restriction of the annular bypass flow. This particular embodiment comprises:

an axisymmetric plug launcher housing having upper and lower ends, a launcher housing bore, a launcher housing wall, and a launcher housing axis;

a generally tubular plug receiver cage ("receiver cage") having upper and lower ends, a plug receiver cage bore ("receiver bore"), and a receiver cage wall, wherein:

the receiver cage is disposed within the launcher housing bore (preferably but not necessarily coaxially);

the launcher housing bore axially supports the receiver cage at the upper and/or lower ends thereof, with a receiver annulus being formed between the launcher housing and the receiver cage;

the receiver bore is sized to accommodate a selected plug (which could be in the form of a volume of balls), and to allow downstream passage of the plug under flow conditions; and the receiver cage has a set of upper receiver cage ports and a set of lower receiver cage ports extending through the receiver cage wall, leaving an unported interval between the upper and lower receiver cage ports, and with the unported interval defining a retained plug interval in a medial region of the receiver cage, with the length of the retained plug interval being selected to be at least approximately equal to the length of the selected plug;

one or more rotatable shafts ("paddle shafts") extending through openings in the launcher housing wall and the receiver wall, wherein the rotational axes of the paddle shafts ("paddle shaft axes") are perpendicular to, but transversely offset from, the launcher housing axis;

one or more paddles coupled to the one or more paddle shafts so as to be movable between a hold position and a launch position by selective rotation of the paddle shafts, wherein the paddles are configured:

to occlude the receiver bore sufficiently to retain a selected minimum size of plug (which plug may comprise either a unitary plug or a collection of one or more objects) so as to retain the plug within the receiver bore fluid flow path, and to allow substantially unrestricted bypass fluid flow (via the receiver annulus) when the plug launcher is in the hold position;

to release the plug into the receiver bore fluid flow path and to substantially or fully restrict annular bypass fluid flow, when the plug launcher is in the launch position; and such that movement of the paddles from the hold position to the launch position will tend to allow the plug to move in the downstream direction, and progressively restrict bypass fluid flow; and actuation means, for rotating the paddle shafts to move the paddles between the hold and launch positions.

In their fully-retracted position, the paddles form part of the receiver cage wall, with the associated lower receiver cage ports fitting closely around each paddle. Sealing elements may be placed on the receiver cage or on the paddles to effect fluid sealing when the paddles are fully retracted.

Embodiment Using Paddles Configured to Occlude and Control Fluid Flow Through the Plug Launcher Bore or the Receiver Bore In alternative embodiments in accordance with the present disclosure, the plug launcher may incorporate one or more paddles configured to occlude the plug launcher bore or the receiver bore (as the case may be) sufficiently to substantially restrict or prevent fluid flow when in the hold position, and not to restrict the plug launcher bore (or the receiver bore) when in the launch position. Sealing elements may be placed on the paddles to assist flow restriction of the plug launcher bore (or the receiver bore) when the paddles are in the hold position.

Embodiments Using Support Rings to Reduce Launcher Housing Weight or Cost

In another embodiment in accordance with the present disclosure, the plug launcher of the cementing head apparatus incorporates one or more support rings circumferentially disposed around the plug launcher housing at one or more selected locations, to provide sealing and other desired functionalities, such as structurally reinforcing the launcher housing to enable reduction of the launcher housing wall thickness and in turn reducing the plug launcher's weight and manufacturing costs while meeting all essential structural performance requirements. This embodiment of the plug launcher comprises:

an axisymmetric launcher housing having upper and lower ends, a launcher housing bore, a launcher housing wall, and a launcher housing axis;

one or more support rings circumferentially mounted on the launcher housing, wherein the one or more support rings:

fit sealingly with the launcher housing around an opening in the launcher housing wall to provide access to the launcher housing bore and to contain fluid pressure within the plug launcher; and are close fitting to the launcher housing and may structurally reinforce the launcher housing.

The support rings may be permanently fixed to the launcher housing, or may be demountable. A support ring may be either a single part or an assembly of two or more parts.

In a further embodiment in accordance with the present disclosure, the plug launcher of the cementing head apparatus incorporates one or more support rings circumferentially disposed around the plug launcher housing that are integral with the actuation means for rotating the paddle shafts to move the paddles between the hold and launch positions. This particular embodiment of the plug launcher comprises:

an axisymmetric launcher housing having upper and lower ends, a launcher housing bore, a launcher housing wall, and a launcher housing axis;

a generally tubular receiver cage having upper and lower ends, a receiver bore, and a receiver cage wall, wherein:

the receiver bore is in upstream fluid communication with the launcher housing bore; and the receiver bore includes a retained plug interval for receiving a selected plug; and is sized to allow passage of the selected plug downstream of the retained plug interval;

one or more paddle shafts extending through openings in the launcher housing wall and the receiver wall, wherein the paddle shaft axes are perpendicular to, but transversely offset from, the launcher housing axis;

one or more paddles coupled to the paddle shafts so as to be movable between a hold position and a launch position by selective rotation of the paddle shafts, wherein the paddles are configured:

to retain a plug in the receiver bore fluid flow path when the plug launcher is in the hold position; and to release the plug into the receiver bore fluid flow path when the plug launcher is in the launch position;

actuation means, for rotating the paddle shafts to move the paddles between the hold and launch positions; and one or more support rings circumferentially mounted on the launcher housing, wherein the one or more support rings:

fit sealingly with the launcher housing and with the paddle shafts to contain fluid pressure within the plug launcher;

are close fitting to the launcher housing and may structurally reinforce the launcher housing;

are close fitting to the paddle shafts to hold the paddle shafts in alignment with the openings in the launcher housing wall and the receiver cage wall; and is integral to the actuation means for moving the paddle shafts with the paddles between the hold position and the launch position.

Paddle Actuation

Non-limiting examples of alternative actuation means and methods for rotating the paddle shafts between hold and launch positions include:

(1) manual rotation of the paddle shafts;

(2) a mechanical linkage converting linear movement of one or more fluid pistons to rotation of the paddle shafts;

(3) a rack-and-pinion gear system converting linear movement of one or more fluid pistons to rotation of the paddle shafts; and (4) a spur gear drive or a worm gear drive converting rotary movement of an electric or fluid power motor to rotation of the paddle shafts.

Embodiment Incorporating Cement Swivel Assembly

Embodiments of cementing head apparatus in accordance with the present disclosure may incorporate a "cement swivel" tool coupled to the plug launcher, to facilitate the introduction of a flow of cement slurry from a drilling rig into the launcher housing bore while the plug launcher is rotating. In one such embodiment, the cement swivel tool comprises:

a generally axisymmetric swivel housing having a swivel housing bore and one or more swivel housing side ports;

a generally axisymmetric mandrel having a cylindrical outer surface, a cylindrical mandrel bore, and one or more mandrel side ports in fluid communication with the mandrel bore, wherein:

the mandrel is coaxially disposed within the swivel housing bore;

the swivel housing bore sealingly engages the cylindrical outer surface of the mandrel to contain fluid pressure within the cement swivel tool; and an annular flow channel is formed between the outer surface of the mandrel and the swivel housing bore, permitting the flow of fluid between the swivel housing side ports and the mandrel side ports;

two or more bearing elements permitting free relative rotation between the mandrel and the swivel housing and preventing relative axial translation between the mandrel and the swivel housing; and one or more support rings circumferentially mounted on the swivel housing, wherein the one or more support rings:

fit sealingly with the swivel housing to contain fluid pressure within the cement swivel tool;

are close fitting to the housing and may structurally reinforce the swivel housing;

have one or more ports for the connection of fluid flow lines from a drilling rig; and have one or more fluid flow channels through which cement slurry and other fluids can be transferred between the connected flow lines to the swivel housing side ports.

The cementing head apparatus may be designed such that the cement swivel tool is demountable from the plug launcher, and such that the cement swivel tool and the plug launcher are independently operable. Alternatively, the cementing head apparatus may be designed to integrate the cement swivel into the plug launcher, such that the cement swivel tool and the plug launcher must be assembled together as a single tool for operation.

Accordingly, the present disclosure teaches a cementing head apparatus including a plug launcher comprising:

a launcher housing having an upper end, a lower end, a launcher housing bore, a launcher housing wall, and a launcher housing axis;

a paddle valve assembly comprising one or more paddles, said one or more paddles being selectively movable between:

a hold position, in which the paddles extend into the primary receiver bore so as to retain a selected plug positioned within the primary receiver bore; and a launch position, in which the paddles are sufficiently retracted from the hold position such that the paddles do not restrict passage of the plug through the receiver bore; and paddle actuation means, for moving the one or more paddles between the hold position and the launch position.

Depending on particular operational requirements, which may include the type of plug to be launched, the paddles may either substantially or less than substantially occlude the launcher housing bore when the paddles are in the hold position.

In one embodiment, the plug launcher also includes a generally axisymmetric primary receiver cage having an upper end, a lower end, a primary receiver bore, and a primary receiver wall, said primary receiver cage being disposed within the launcher housing bore. The primary receiver cage will be typically but not necessarily coaxial with the launcher housing.

In one variant embodiment, the plug launcher may also have a primary receiver annulus defined by the launcher housing bore and the primary receiver cage. In this embodiment, the primary receiver cage may have one or more upper primary receiver cage ports and one or more lower primary receiver cage ports extending through the primary receiver wall, with an unported primary receiver cage interval between the upper and lower primary receiver cage ports defining a primary retained plug interval. The one or more paddles will extend into primary receiver bore when in the hold position, so as to hole a selected plug disposed within the primary retained plug interval. The paddles may either substantially or less than substantially occlude the primary receiver bore when the paddles are in the hold position.

In another variant embodiment, the plug launcher may further comprise a secondary receiver cage having a secondary receiver bore and a secondary receiver wall, with the secondary receiver cage being disposed within the primary receiver bore (typically but not necessarily coaxially). One or more upper secondary receiver cage ports and one or more lower secondary receiver cage ports extend through the secondary receiver wall. The paddles extend into the secondary receiver bore when the paddles are in the hold position, in which position the paddles may either substantially or less than substantially occlude the secondary receiver bore. The paddles may substantially occlude the lower secondary receiver cage ports when in the launch position.

The paddle actuation means includes one or more paddle shafts, with each paddle shaft being coupled to an associated paddle, and mounted to the plug launcher so as to be rotatable about a paddle shaft axis transverse to but offset from the launcher housing axis, and thereby to selectively move the associated paddle between the hold position and the launch position.

The paddle shafts may be rotated by any suitable and effective means. By way of non-limiting example, the paddle shafts may be rotated:

manually;

by a mechanical linkage configured to convert linear movement of one or more fluid-actuated pistons to rotation of the paddle shafts;

by a gear system configured to convert linear movement of one or more fluid-actuated pistons to rotation of the paddle shafts; or by a gear system configured to convert rotary movement of an electric or fluid-actuated motor to rotation of the paddle shafts.

In some variant embodiments, the plug launcher may incorporate fluid swivel means to facilitate delivery of actuating fluid to fluid-actuated pistons or motors while the plug launcher is being rotated by a drilling rig.

Embodiments of the plug launcher may also incorporate one or more support rings circumferentially mounted to the launcher housing and sealingly coupled in at least one region of the interface between the support ring and the launcher housing, to facilitate access to the interior of the housing while providing fluid containment. The support rings may be configured to incorporate one or more components of the paddle actuation means. In addition, the support rings may be designed to structurally reinforce the launcher housing, and thus enable the wall thickness and weight of the plug launcher to be reduced without loss of functionality or effective structural strength.

Embodiments of a cementing head apparatus in accordance with the present disclosure may include a cement swivel assembly mounted to the upper end of the launcher housing. In one such embodiment, the cement swivel assembly comprises:

a generally axisymmetric swivel housing having a swivel housing bore and one or more swivel housing side ports;

a generally axisymmetric mandrel having a cylindrical outer surface, a cylindrical mandrel bore, and one or more mandrel side ports in fluid communication with the mandrel bore, wherein:

the mandrel is coaxially disposed within the swivel housing bore;

the swivel housing bore sealingly engages the cylindrical outer surface of the mandrel to contain fluid pressure within the cement swivel tool; and an annular flow channel is formed between the outer surface of the mandrel and the swivel housing bore, enabling fluid flow between the swivel housing side ports and the one or more mandrel side ports;

two or more bearing elements permitting free relative rotation between the mandrel and the swivel housing and preventing relative axial translation between the mandrel and the swivel housing; and one or more support rings circumferentially mounted on the swivel housing, wherein the one or more support rings fit sealingly with the swivel housing to contain fluid pressure within the cement swivel tool; have one or more ports for the connection of fluid flow lines from a drilling rig; and have one or more fluid flow channels through which cement slurry and other fluids can be transferred between the connected flow lines to the one or more swivel housing side ports.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Manually-Actuated Embodiment

Figure 1:
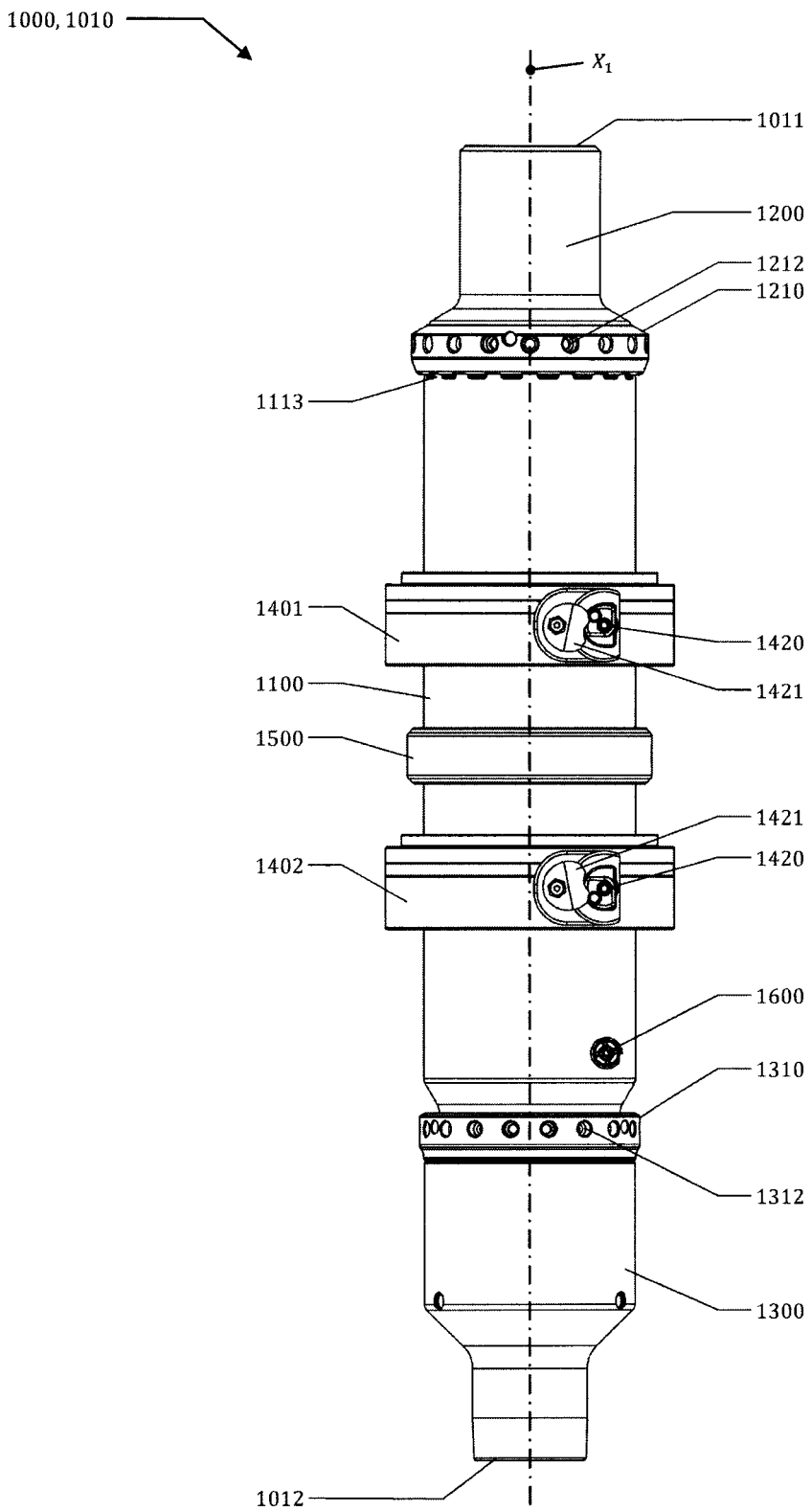
FIG. 1 is an elevation of one embodiment of a cementing head apparatus in accordance with the present disclosure, including a plug-launching tool ("plug launcher") comprising upper and lower paddle valve subassemblies configured to independently retain and release two plugs, and shown with the upper paddle valve subassembly in the hold position and with the lower paddle valve subassembly in the launch position.

FIG. 1 illustrates a first embodiment 1000 of a cementing head apparatus in accordance with the present disclosure, comprising a plug-launching tool ("plug launcher") 1010 configured for launching two plugs. Plug launcher 1010 has an upper end 1011 and a lower end 1012 and comprises:

- a generally axisymmetric launcher housing 1100 having an upper end 1100U, a lower end 1100L, a launcher housing bore 1109, a launcher housing wall 1115, and a launcher housing axis $X_1$;
- a generally axisymmetric and stepped top cap 1200 having a top cap bore, and which threadingly engages upper end 1100U of launcher housing 1100 and is secured against rotation relative to launcher housing 1100 by a lock sleeve 1210 and one or more lock sleeve lugs 1212;
- a generally axisymmetric and stepped bottom cap 1300 that threadingly engages lower end 1100L of launcher housing 1100, and is secured from relative rotation with launcher housing 1100 by a lock sleeve 1310 and one or more log sleeve lugs 1312;
- upper and lower paddle valve subassemblies 1401 and 1402 comprising one or more paddle elements ("paddles") 1411 for retaining and releasing ("launching") plugs positioned within housing 1100;
- an inspection port subassembly 1500; and
- a release indicator 1600.

In FIG. 1, upper paddle valve subassembly 1401 is shown in the hold position, and lower paddle valve subassembly 1402 is shown in the launch position.

Figure 2:
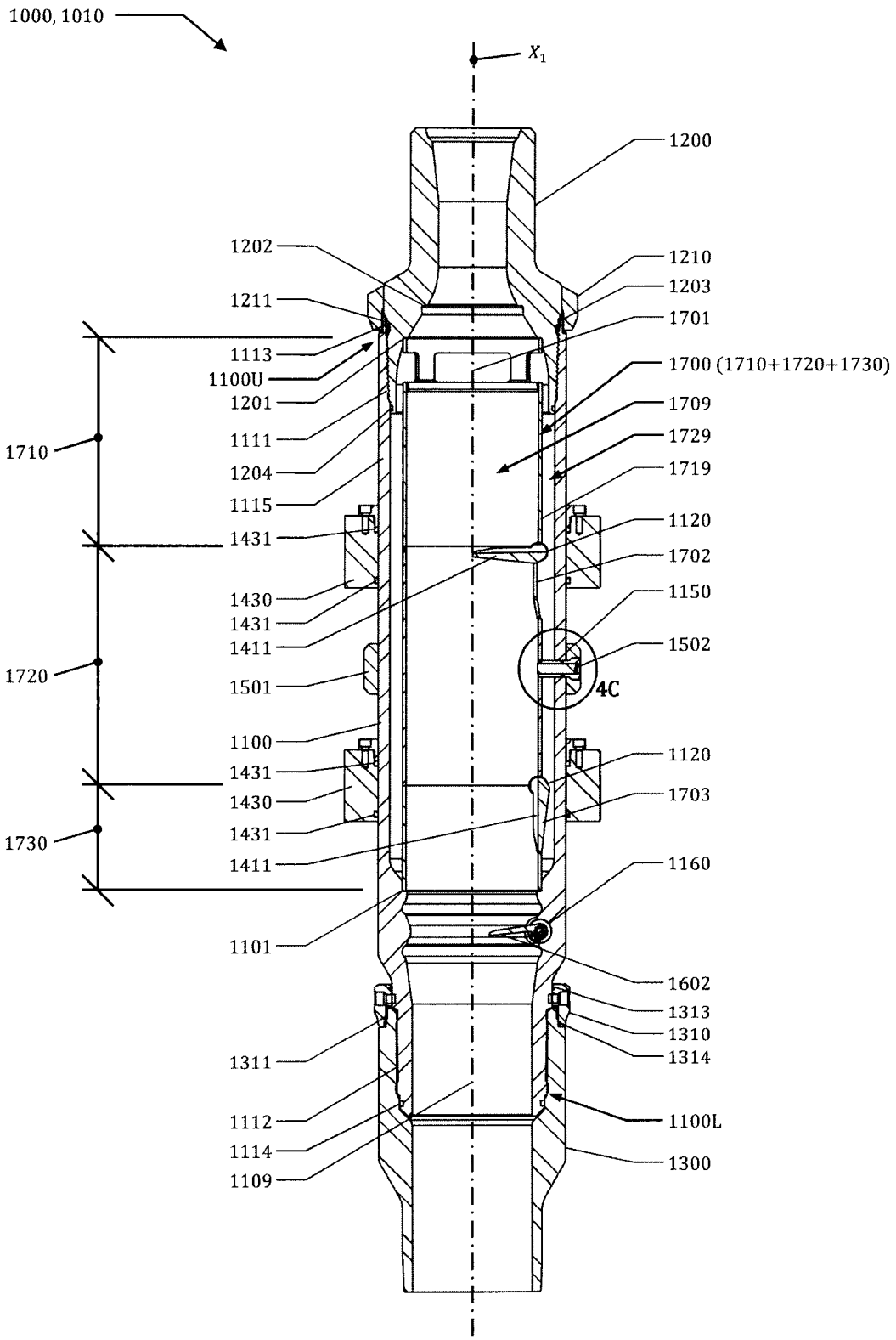
FIG. 2 is a longitudinal section through the plug launcher in FIG. 1.

FIG. 2 is a longitudinal section through plug launcher 1010 illustrating internal components and features. Launcher housing 1100 (which may comprise either a single part or an assembly of parts) has a launcher housing bore 1109, an upper connection thread 1111 that engages top cap 1200, and an external lower connection thread 1112 that engages bottom cap 1300. Launcher housing 1100 also has a plurality of through-wall openings 1120 for upper and lower paddle valve subassemblies 1401 and 1402, and through-wall openings 1150 and 1160 for inspection port 1500 and release indicator 1600, respectively.

As illustrated in FIG. 2, plug launcher 1010 includes a generally tubular base-size (or "primary") receiver cage 1700 having a base-size (or "primary") receiver bore 1709 and a primary receiver cage wall 1719. Primary receiver cage 1700 is coaxially disposed within launcher housing bore 1109, and may comprise either a single part or an assembly of parts. In the illustrated embodiment, primary receiver cage 1700 comprises an upper section 1710 (corresponding to an upper retained plug interval), a middle section 1720 (corresponding to a lower retained plug interval), and a lower section 1730. Upper receiver cage ports 1701 are disposed near the top of upper section 1710. Lower receiver cage ports 1702 and 1703 are provided in middle section 1720 and lower section 1730 at each respective paddle 1411. Lower receiver cage ports 1702 and 1703 are configured to match paddles 1411 such that paddles 1411 substantially restrict flow through lower receiver cage ports 1702 and 1703 when paddles 1411 are in the launch position, and allow free fluid flow through lower receiver cage ports 1702 and 1703 when paddles 1411 are in the hold position.

Primary receiver cage 1700 is configured to be constrained by top cap 1200 and launcher housing 1100. More specifically, the upper end of primary receiver cage 1700 is supported by a stepped face 1201 of top cap 1200 and the lower end of base-size receiver cage 1700 is supported by a stepped face 1101 of launcher housing 1100.

Figure 3:
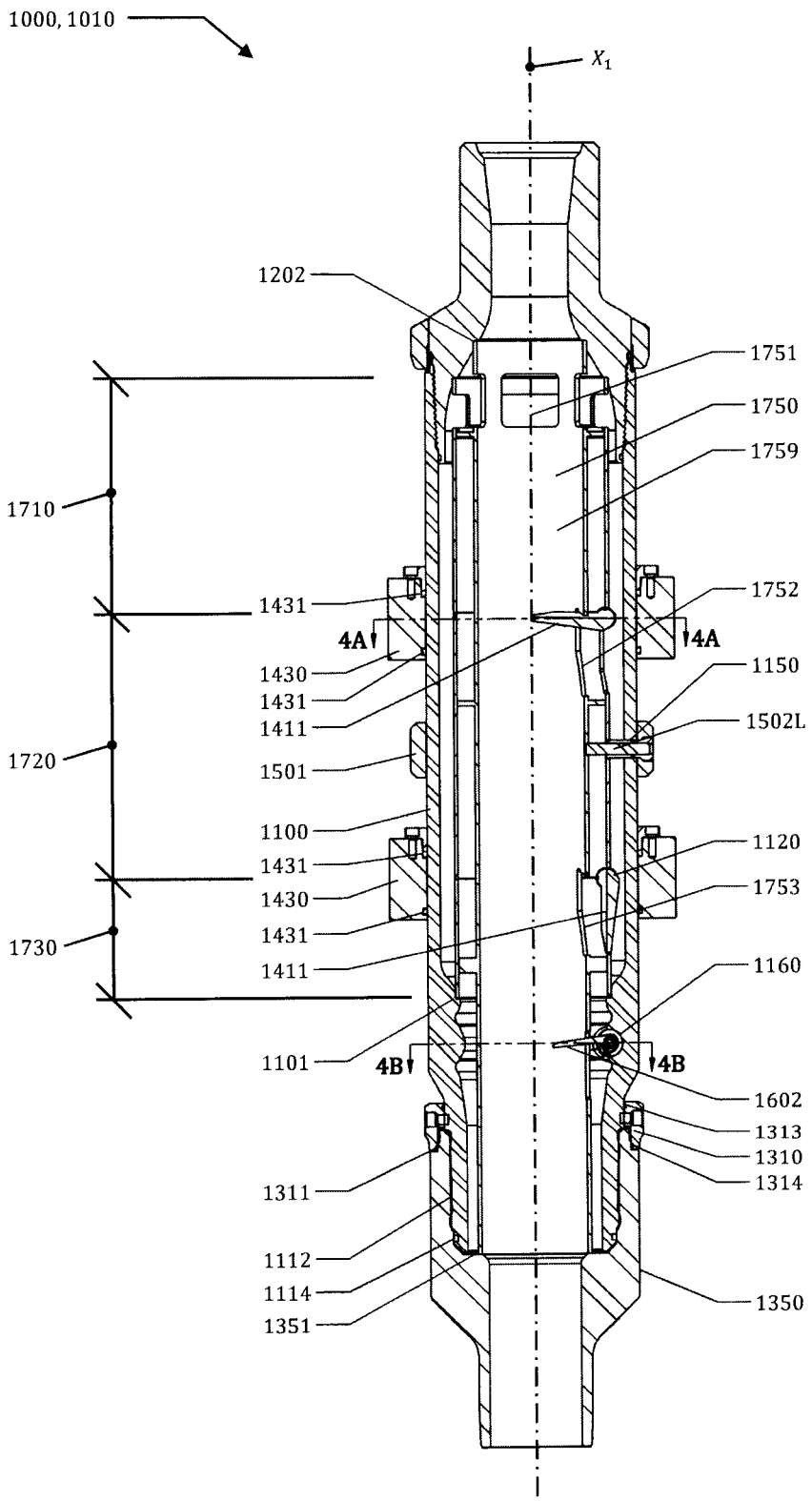
FIG. 3 is a longitudinal section through the plug launcher in FIG. 1, having a reduced-size (or "secondary") receiver cage disposed within a base-size (or "primary") receiver cage, for retaining and launching smaller-diameter plugs, and with the bottom cap of the plug launcher being adapted for connection to a smaller-diameter casing string.

FIG. 3 illustrates plug launcher 1010 with a reduced-size (or "secondary") receiver cage 1750 coaxially disposed within base-size (primary) receiver bore 1709, for launching plugs into a reduced-size casing string. The lower end of bottom cap 1350 is adapted to engage the reduced-size casing. The upper end of secondary receiver cage 1750 is supported by a stepped face 1202 of top cap 1200 and the lower end of secondary receiver cage 1750 is supported by a stepped face 1351 of bottom cap 1350.

Paddle Valve Subassemblies

Figure 4A:
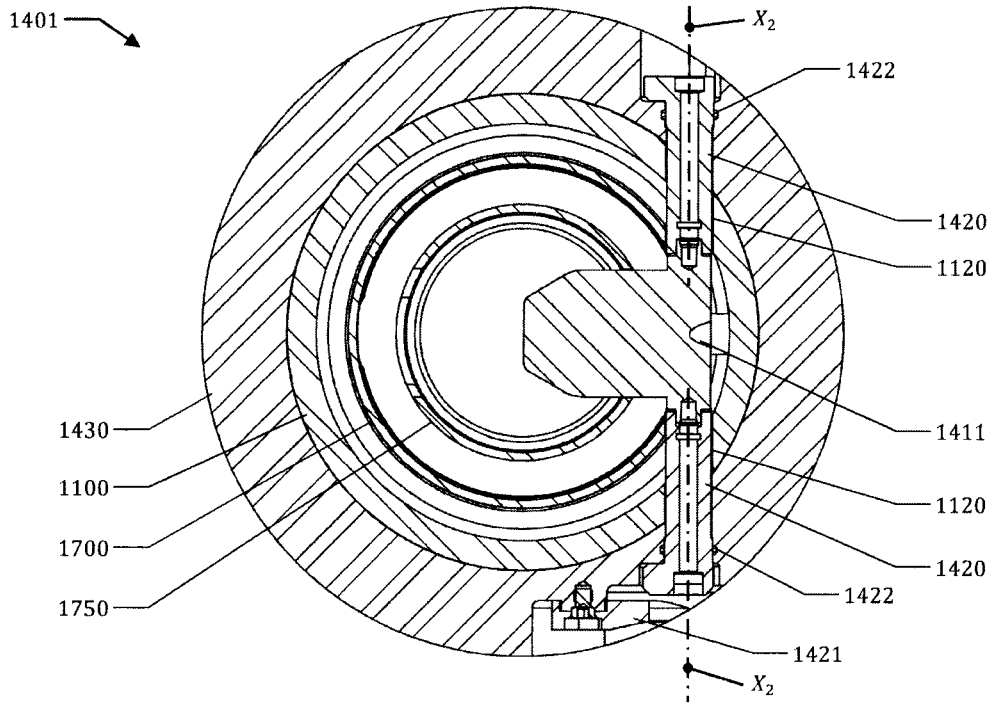
FIG. 4A is a transverse section through the plug launcher in FIG. 3 at the upper paddle valve subassembly.

FIG. 4A is a transverse section through plug launcher 1010 with reduced-size (secondary) receiver cage 1750 installed within base-size (primary) receiver cage 1700, illustrating internal components and features of paddle valve subassemblies 1401 and 1402 when these subassemblies are in the hold position. When paddle 1411 is in the hold position, it obstructs the bore of primary receiver cage 1700 (and the bore 1759 of secondary receiver cage 1750, when present) to retain a plug in the receiver cage bore within plug launcher 1010. The matching base-size lower receiver cage port 1702 or 1703 is open and allows fluid flow to bypass the plug retained in the receiver cage bore. Paddle 1411 is coupled to and supported by rotatable paddle shafts 1420, each of which has a paddle shaft axis $X_2$. Paddle 1411 and paddle shafts 1420 may be secured in the hold position by a latch 1421.

When paddle 1411 is in the launch position, the bore of base-size receiver cage 1700 (or secondary receiver cage 1750, when present) is unobstructed, allowing free passage of a plug to exit plug launcher 1010 into a casing string attached to lower end 1012 of plug launcher 1010. Paddle 1411 in the launch position also substantially restricts flow through the matching base-size lower receiver cage cage port 1702 or 1703. This restriction causes fluid pressure to build in the receiver cage bore above the plug, urging the plug toward lower end 1012. Latch 1421 may also be used to secure paddle 1411 and paddle shafts 1420 in the launch position.

Through-wall valve openings 1120 reduce the ability of launcher housing 1100 to sustain hoop stress generated by internal pressure. Paddle valve support ring 1430 is configured to be close-fitting to the outside surface of launcher housing 1100. As internal pressure is applied to launcher housing 1100, launcher housing 1100 will expand and may contact support ring 1430. As internal pressure is further increased, support ring 1430 will help to limit further expansion of launcher housing 1100 and to minimize structural stresses therein. Paddle valve support ring 1430 also supports paddle shafts 1420 and latch 1421.

Release Indicator

Figure 4B:
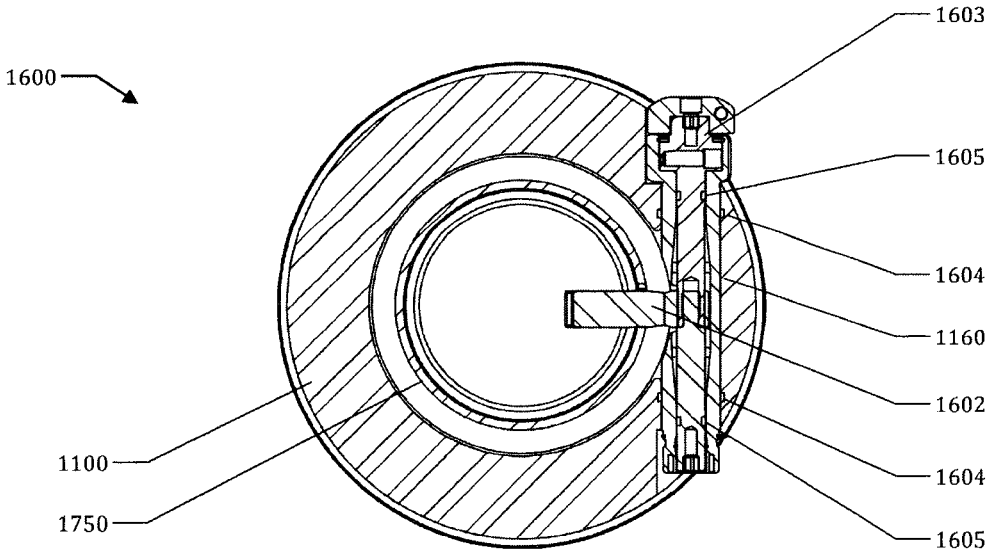
FIG. 4B is a transverse section through the plug launcher in FIG. 3 at the release indicator.

FIG. 4B is a transverse section through plug launcher 1010 at release indicator 1600, which is similar in function to release indicators found in prior art plug launchers.

Launcher housing 1100 in the illustrated embodiment has an increased wall thickness near the axial position of release indicator 1600 to support a release indicator shaft assembly 1603 and to provide seal grooves 1604. When a plug is launched by plug launcher 1010, the plug will deflect a release indicator finger 1602, causing release indicator shaft assembly 1603 to rotate. A flag mounted to release indicator shaft assembly 1603 and extending external to plug launcher 1010 will wave and give a visual indication that the plug has been launched.

Inspection Port Subassembly

Figure 4C:
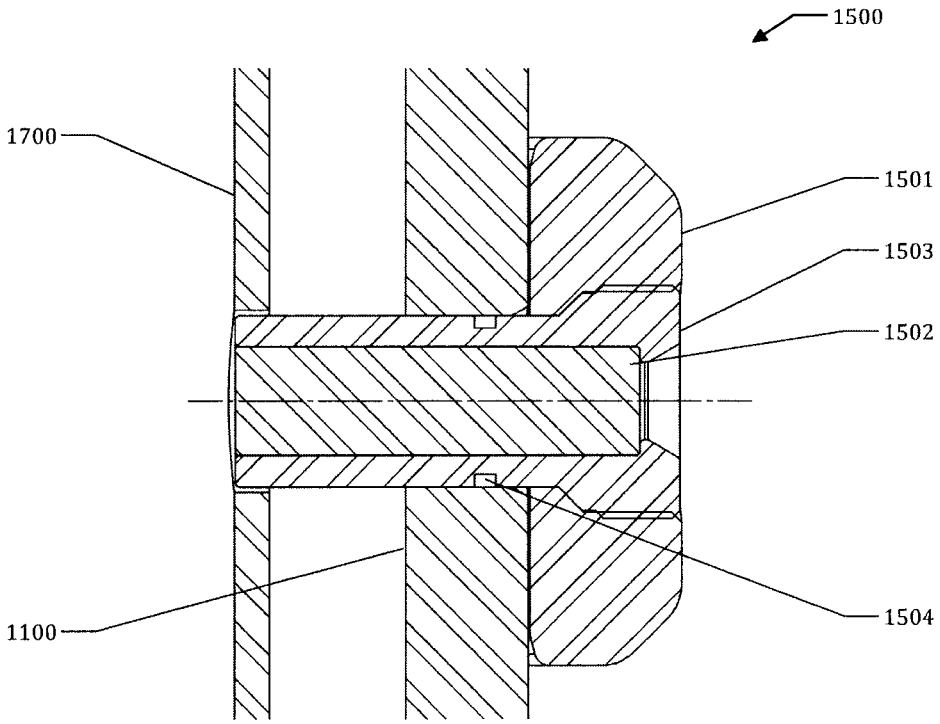
FIG. 4C is a sectional detail of the inspection port subassembly shown in FIG. 2.

FIG. 4C is an enlarged detail of the inspection port subassembly 1500 of plug launcher 1010. In the illustrated embodiment, inspection port subassembly 1500 includes an inspection port support ring 1501, which may be designed to structurally reinforce launcher housing 1100 for enhanced resistance to structural stresses induced by internal pressurization of plug launcher 1010. A sight glass 1502 is sealingly retained within a sight glass holder 1503. Sight glass holder 1503 passes through opening 1150 in launcher housing 1100 and similar holes in base-size receiver cage 1700 (and/or secondary receiver cage 1750, when present), and threadingly engages inspection port support ring 1501. Pressure within plug launcher 1010 is contained by a seal carried by seal groove 1504.

Sight glass 1502 may be replaced with a measurement sensor or another form of detector to monitor the internal operation of plug launcher 1010.

When a secondary receiver cage 1750 is installed in plug launcher 1010, a longer sight glass 1502L may be used.

Actuation

Paddle 1411 and paddle shafts 1420 may be actuated by a variety of different means, and embodiments in accordance with the present disclosure are not limited or restricted to the use of any particular actuation means, whether disclosed herein or not. By way of non-limiting example, the actuation means may comprise suitably-shaped wrenches used by a person operating plug launcher 1010 to actuate latch 1421 and paddle shafts 1420.

In FIG. 1, upper paddle valve subassembly 1401 is shown in the hold position, with latch 1421 securing paddle shafts 1420 in the hold position. Rotation of latch 1421 a small amount counter-clockwise will allow paddle shaft 1420 and paddle 1411 to freely rotate counter-clockwise from the hold position to the launch position. The operator may also use a suitably-shaped wrench to positively turn rotatable paddle shaft 1420 and thereby move paddle 1411 to the launch position (or back to the hold position when resetting plug launcher 1010). Once paddle shaft 1420 and paddle 1411 are in the launch position, the operator may rotate latch 1421 to secure paddle shaft 1420 and paddle 1411 in the launch position.

Fluid Flow and Plug Launching

Plug launcher 1010 may be assembled and loaded with plugs prior to being rigged into a top-drive-suspended casing string. For the configuration shown in FIG. 1, the plugs are placed into base-size (primary) receiver bore 1709 in contact with and retained by paddles 1411 in the hold position. Fluids such as drilling fluid and cement slurry can be pumped through plug launcher 1010. When paddles 1411 are in the hold position and retaining upper and lower plugs, the fluid flow path, in sequence, will be:

- into upper end 1011 of plug launcher 1010 through the bore of top cap 1200;
- into upper end of primary receiver cage 1700, and downward within primary receiver bore 1709 until the flow path is occluded by the loaded upper plug;
- out of primary receiver cage 1700 through upper ports 1701 and into an annular space ("receiver annulus") 1729 between primary receiver cage 1700 and launcher housing 1100;
- downward within receiver annulus 1729 and into primary receiver bore 1709 through lower receiver cage port 1703 below the loaded lower plug;
- downward through the bores of launcher housing 1100 and bottom cap 1300; and
- out lower end 1012 of plug launcher 1010 into the attached casing string.

During normal use of plug launcher 1010, the lower plug will be launched first. Fluid flow through lower receiver cage ports 1703 is substantially restricted as paddle 1411 of lower paddle valve subassembly 1402 is rotated to the launch position as shown in FIG. 2, where paddle 1411 no longer obstructs primary receiver bore 1709, thereby allowing passage of the lower plug downward within primary receiver cage 1700. With lower paddle valve subassembly 1402 in the launch position, the fluid flow path, in sequence, will be:

- into upper end 1011 of plug launcher 1010 through the bore of top cap 1200;
- into the upper end of primary receiver cage 1700, and downward within primary receiver bore 1709 until the flow path is occluded by the loaded upper plug;
- out of primary receiver cage 1700 through upper ports 1701 and into receiver annulus 1729;
- downward within receiver annulus 1729 and into primary receiver bore 1709 through lower receiver cage port 1702 below the loaded upper plug and above the loaded lower plug;
- downward through launcher housing bore 1109; and
- continuing through the bore of bottom cap 1300 until it reaches lower end 1012 of plug launcher 1010, at which point the lower plug exits plug launcher 1010 and enters the attached casing string.

The flow of fluid in the fluid flow path defined immediately above will push the lower plug down through primary receiver bore 1709.

The upper plug may be launched after the lower plug has been launched. Fluid flow through lower receiver cage ports 1702 is substantially restricted as paddle 1411 of upper paddle valve subassembly 1401 is rotated into the launch position, in which paddle 1411 no longer obstructs primary receiver bore 1709, thereby allowing passage of the upper plug downward within primary receiver cage 1700. With upper paddle valve subassembly 1401 in the launch position, the fluid flow path, in sequence, will be:

- into upper end 1011 of plug launcher 1010 through the bore of top cap 1200;
- into the upper end of primary receiver cage 1700, and down primary receiver bore 1709 until the flow path reaches the top of the upper plug;
- downward through launcher housing bore 1109; and
- continuing through the bore of bottom cap 1300 or 1350 until it reaches lower end 1012 of plug launcher 1010, at which point the upper plug exits plug launcher 1010 and enters the attached casing string.

The flow of fluid in the fluid flow path defined immediately above will push the upper plug down through primary receiver bore 1709.

As a paddle 1411 is progressively rotated from the hold position to the launch position, the fluid flow through lower receiver cage port 1702 or 1703 will be substantially restricted only when paddle 1411 is near the launch position due to the shape and position of paddle 1411 relative to lower receiver cage port 1702 or 1703. Therefore, fluid pressure above the associated plug will rise substantially only when paddle 1411 is near the launch position. At that position, receiver bore 1709 will be largely unobstructed by paddle 1411, and some downward movement of the associated plug will be permitted. The functional relationship described above will limit the fluid pressure differential across the plug and protect the plug from damage.

As each plug is pushed downward by fluid pressure, it will contact release indicator finger 1602 and activate release indicator 1600.

Fluid Containment and Contaminant Protection

Seal grooves carrying suitable seal elements are provided at several locations within plug launcher 1010 to contain fluid pressure within the tool bore, including:

- external seal groove 1204 of top cap 1200;
- external seal groove 1504 of inspection port sight glass holder 1503;
- internal seal grooves 1431 and 1422 of paddle valve support rings 1430;
- internal seal grooves 1604 in through-wall release indicator opening 1160 of launcher housing 1100;
- external seal grooves 1605 in release indicator shaft assembly 1603; and
- external seal groove 1114 of launcher housing 1100.

Seal grooves with suitable seal elements are provided at several additional locations within plug launcher 1010 to protect the tool from external contaminants, including:

- external seal grooves 1203 of top cap 1200; and
- internal seal grooves 1313 and 1314 of bottom cap lock sleeve 1310.

Transferring Hoist and Torque Loads

Plug launcher 1010 provides for the transfer of hoist and torque loads between upper end 1011 of plug launcher 1010 connected to the drilling rig and lower end 1012 of plug launcher 1010 connected to the casing string. This allows drilling rig operators to reciprocate and/or rotate the casing string during cementing operations.

The upper end of top cap 1200 is adapted for securing the assembly (by any suitable means) to components rigged into a top-drive drilling rig. The lower end of top cap 1200 has external threads that are engageable with internal threads 1111 on the upper end of launcher housing 1100 for transferring hoist loads from top cap 1200 to launcher housing 1100. Top cap lock sleeve 1210 has an internal splined section 1211 engageable with external splined section 1113 on launcher housing 1100, and is secured to top cap 1200 by a set of threaded lugs 1212. Top cap lock sleeve 1210 is thus capable of transferring torque between top cap 1200 and launcher housing 1100.

The upper end of bottom cap 1300 or 1350 has internal threads that are engageable with external threads 1112 on the lower end of launcher housing 1100 for transferring hoist loads from launcher housing 1100 to bottom cap 1300 or 1350. Bottom cap lock sleeve 1310 has an internal splined section 1311 engageable with external splined section 1303 on bottom cap 1300 or 1350, and is secured to launcher housing 1100 by a set of threaded lugs 1312. Bottom cap lock sleeve 1310 is thus capable of transferring torque between launcher housing 1100 and bottom cap 1300. The lower end of bottom cap 1300 or 1350 is adapted (by any suitable means) for connection to a casing string.

Configuration for Reduced-Size Plugs

For launching reduced-size plugs, reduced-size (secondary) receiver cage 1750 is mounted within base-size (primary) receiver cage 1700 within plug launcher 1010, as shown in FIG. 3, prior to installing top cap 1200 onto launcher housing 1100. Bottom cap 1300 for base-size casing is also replaced with bottom cap 1350 for reduced-size casing. Secondary receiver cage 1750 is held in place by stepped face 1202 of top cap 1200 and stepped face 1351 of bottom cap 1350. Secondary receiver cage 1750 has upper ports 1751, and lower ports 1752 and 1753 for the upper and lower paddles 1411, respectively.

The operation of plug launcher 1010 to launch reduced-size plugs is otherwise unchanged.

Additional Embodiments with Alternative Plug Launcher Actuation Means

Plug-launching tools ("plug launchers") of herein-disclosed cementing head apparatus may be readily adapted for pneumatic or hydraulic fluid power actuation (or other actuation means) by modifying the disclosed paddle valve subassemblies in accordance with known technologies and methods. Pneumatic or hydraulic components can be used to apply the forces necessary to rotate paddles between the hold and launch positions.

Additionally, plug launchers of disclosed cementing head apparatus may be readily adapted for retaining and releasing a charge of small articles such as balls by modifying the shape of the paddles to sufficiently obstruct the receiver cage bore when the paddles are in the hold position so as to prevent unintended release of retained articles prior to launch.

Primary Components and Features

Figure 5:
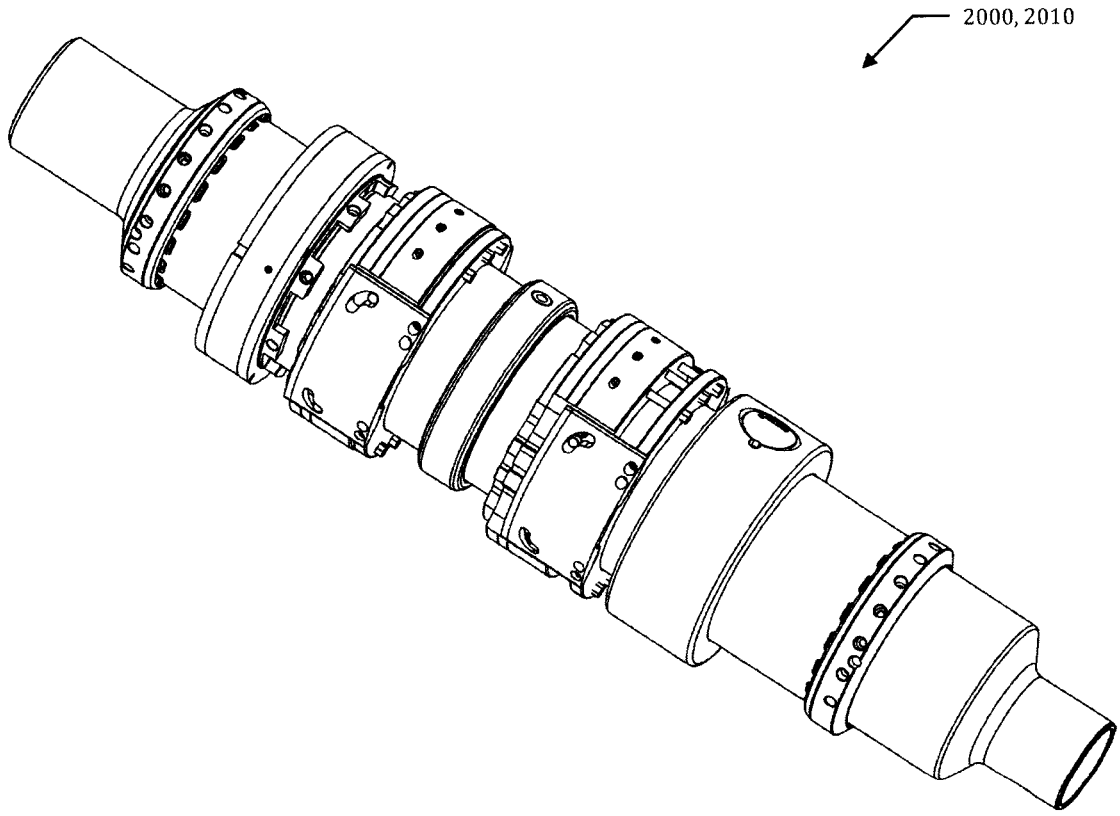
FIG. 5 is an isometric view of another embodiment of a cementing head apparatus in accordance with the present disclosure, comprising a plug launcher shown with the actuation means for the upper paddles in the hold position, and with the actuation means for the lower paddles in the launch position.
Figure 6:
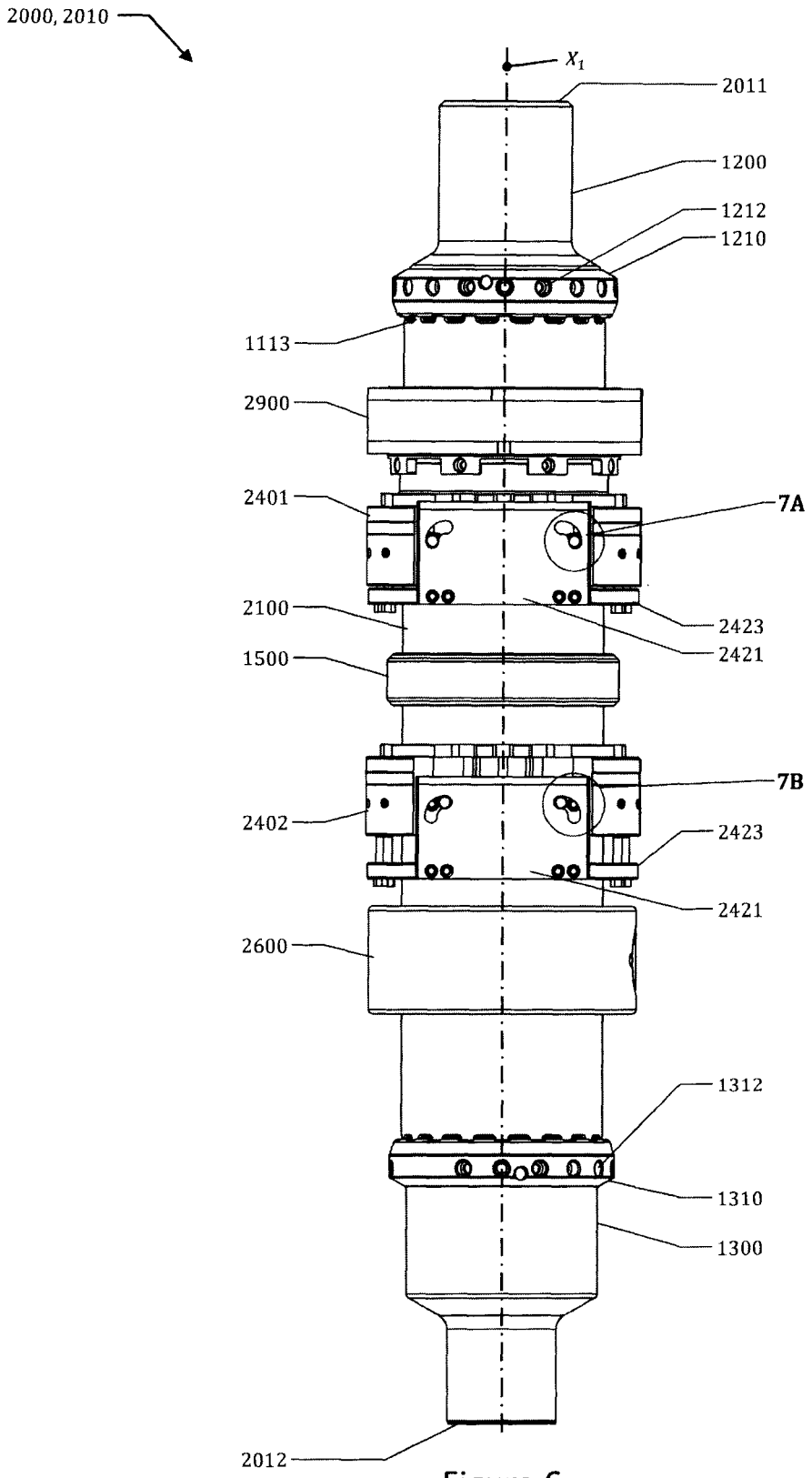
FIG. 6 is an elevation of the plug launcher in FIG. 5.

FIGS. 5 and 6 illustrate an alternative embodiment 2000 of a cementing head apparatus in accordance with the present disclosure including a plug launcher 2010 that uses fluid power actuation means to rotate paddle shafts 1420 between the hold and launch positions. Plug launcher 2010 has an upper end 2011 and a lower end 2012. Some components of alternative embodiment 2000 may be identical to components of first embodiment 1000. Externally-visible differences from embodiment 1000 include the following:

- two fluid-powered (e.g., pneumatically-actuated) paddle valve subassemblies 2401 and 2402 replace manual-release paddle valve subassemblies 1401 and 1402; and
- a fluid swivel subassembly 2900 is added to facilitate the flow of actuating fluid between hoses connected to the drilling rig and hoses connected to paddle valve subassemblies 2401 and 2402, and to enable such fluid flow when plug launcher 2010 is rotating with the casing string.

In the embodiment shown in FIGS. 5 and 6, upper paddle valve subassembly 2401 is shown in the hold position, and lower paddle valve subassembly 2402 is shown in the launch position.

Plug launcher 2010 comprises a release indicator subassembly 2600 incorporating a support ring 2601, in contrast to release indicator 1600 which is directly held by launcher housing 1100. Advantages of this configuration relative to that of plug launcher 1010 are described later herein.

Figure 8:
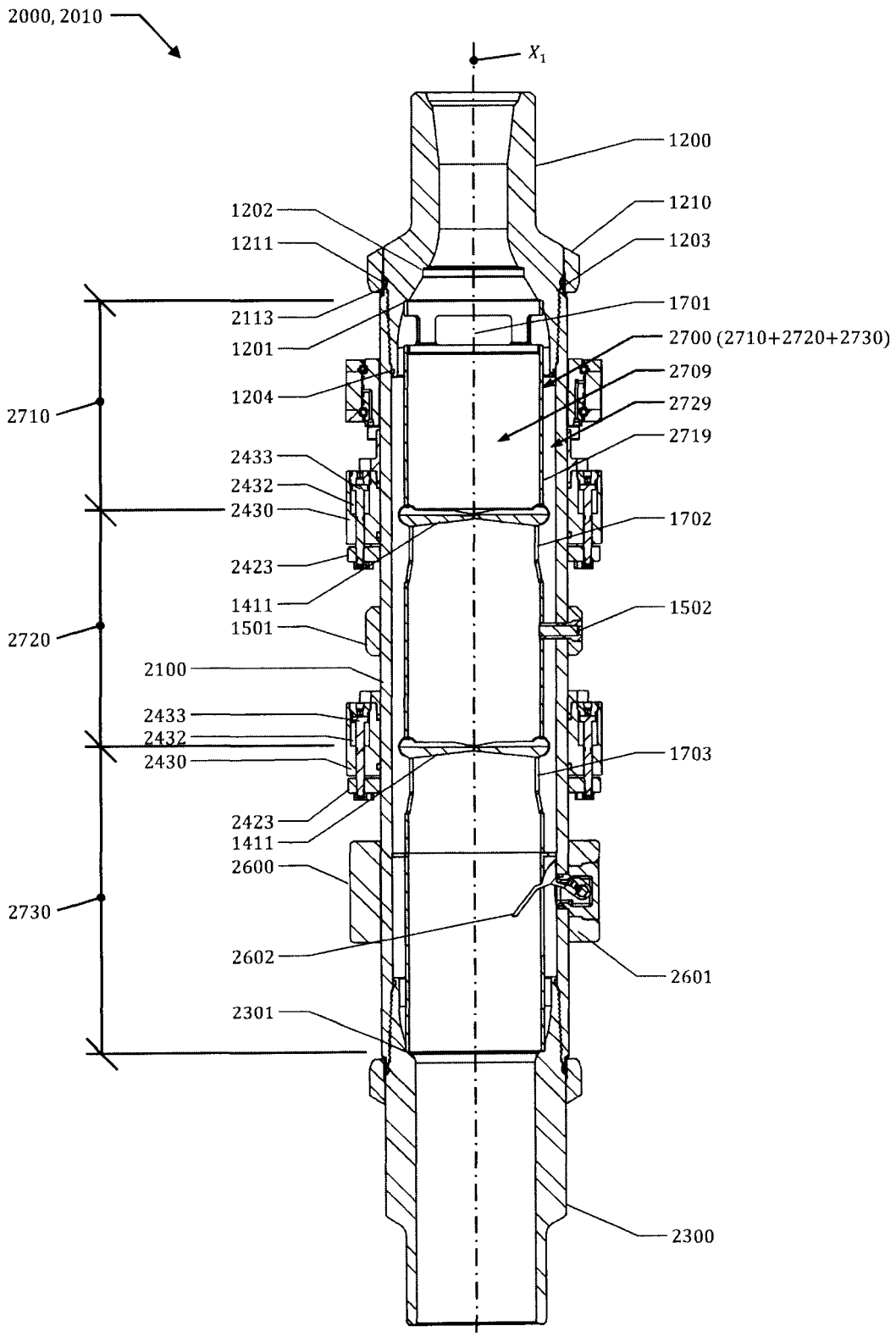
FIG. 8 is a longitudinal section through the plug launcher in FIG. 5, but with the upper and lower paddle valve subassemblies both in the hold position.

FIG. 8 is a longitudinal section through plug launcher 2010 showing upper and lower paddle valve subassemblies 2401 and 2402 both in the hold position. In this embodiment, a primary receiver cage 2700 having a receiver bore 2709 and receiver cage wall 2719 comprises an upper section (upper retained plug interval) 2710, a middle section (lower retained plug interval) 2720, and a lower section 2730. An annular space ("receiver annulus") 2729 exists between primary receiver cage 2700 and launcher housing 2100. Primary receiver cage 2700 is axially constrained by top cap 1200 and launcher housing 2100. More specifically, the upper end of primary receiver cage 2700 is supported by a stepped face 1201 of top cap 1200, and the lower end of primary receiver cage 2700 is supported by a stepped face 2301 of bottom cap 2300.

Figure 9A:
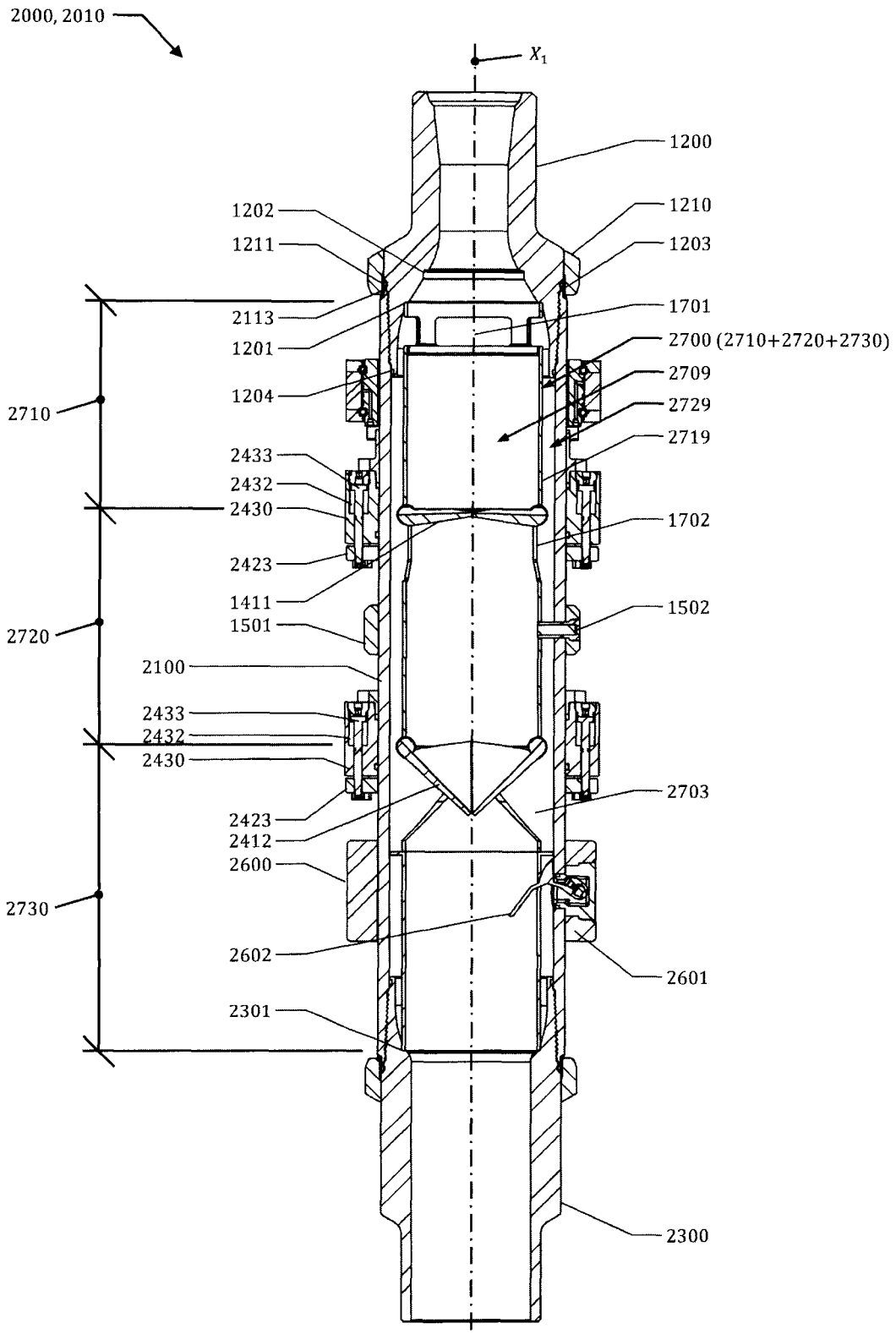
FIG. 9A is a longitudinal section through a plug launcher as in FIG. 5, but configured with alternatively-shaped paddles installed in the lower paddle valve subassembly, and shown with the upper and lower paddle valve subassemblies both in the hold position.
Figure 9B:
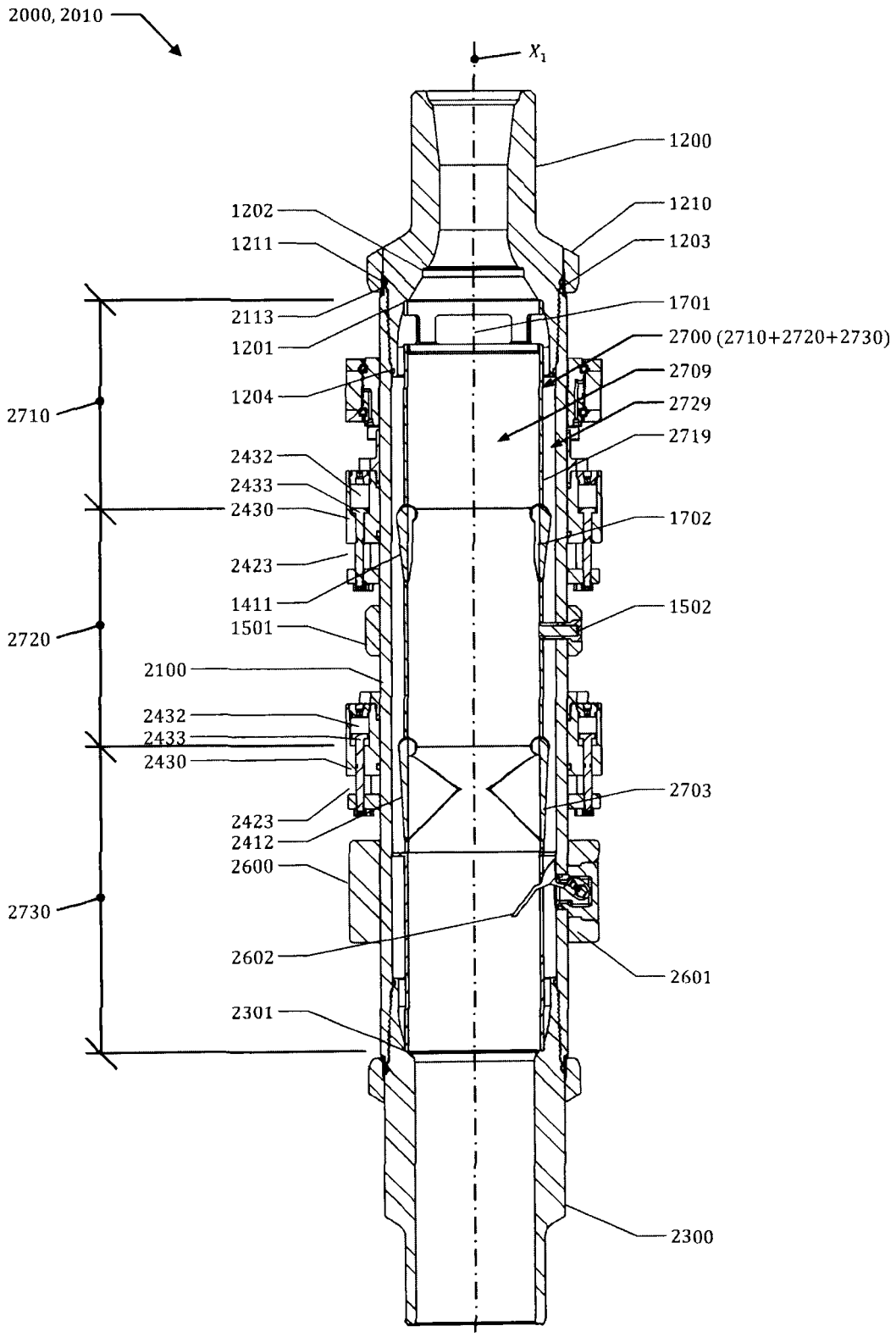
FIG. 9B is a longitudinal section through the plug launcher in FIG. 9A, but with the upper and lower paddle valve subassemblies both in the launch position.

For launching small articles such as balls that have a small transverse section relative to the casing bore, the paddles are configured to effectively occlude the receiver cage bore. By way of non-limiting example, FIGS. 9A and 9B show plug launcher 2010 with paddles 2412 in accordance with an alternative paddle embodiment configured to effectively occlude primary receiver bore 2709 so as to enable retention of small articles. Lower section 2730 of primary receiver cage 2700 contains ports 2703 that are configured to match paddles 2412.

Figure 10A:
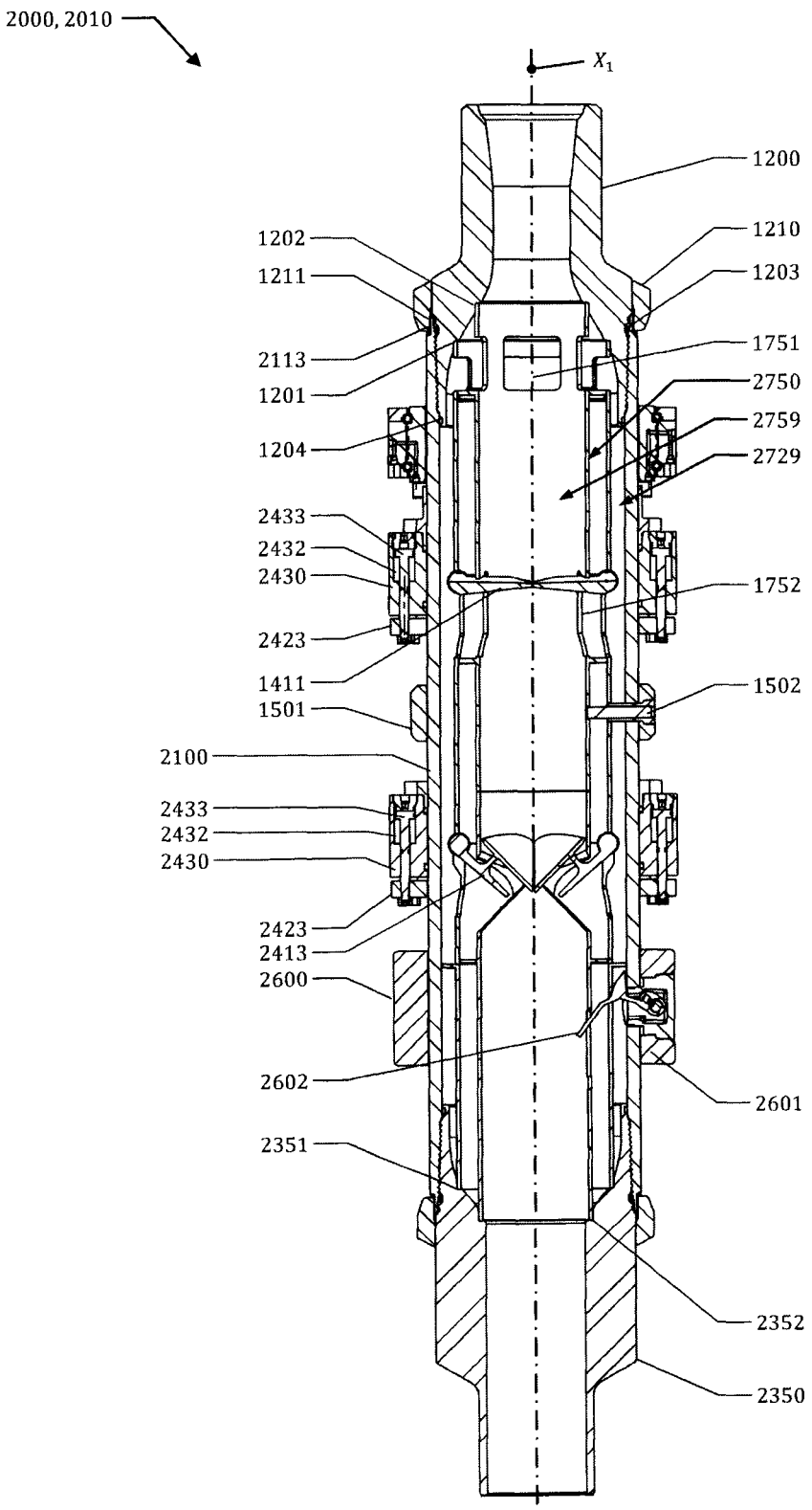
FIG. 10A is a longitudinal section through the plug launcher as in FIG. 9A, but with a size-reducing secondary receiver cage and associated paddles installed, and with the upper and lower paddle valve subassemblies both in the hold position.
Figure 10B:
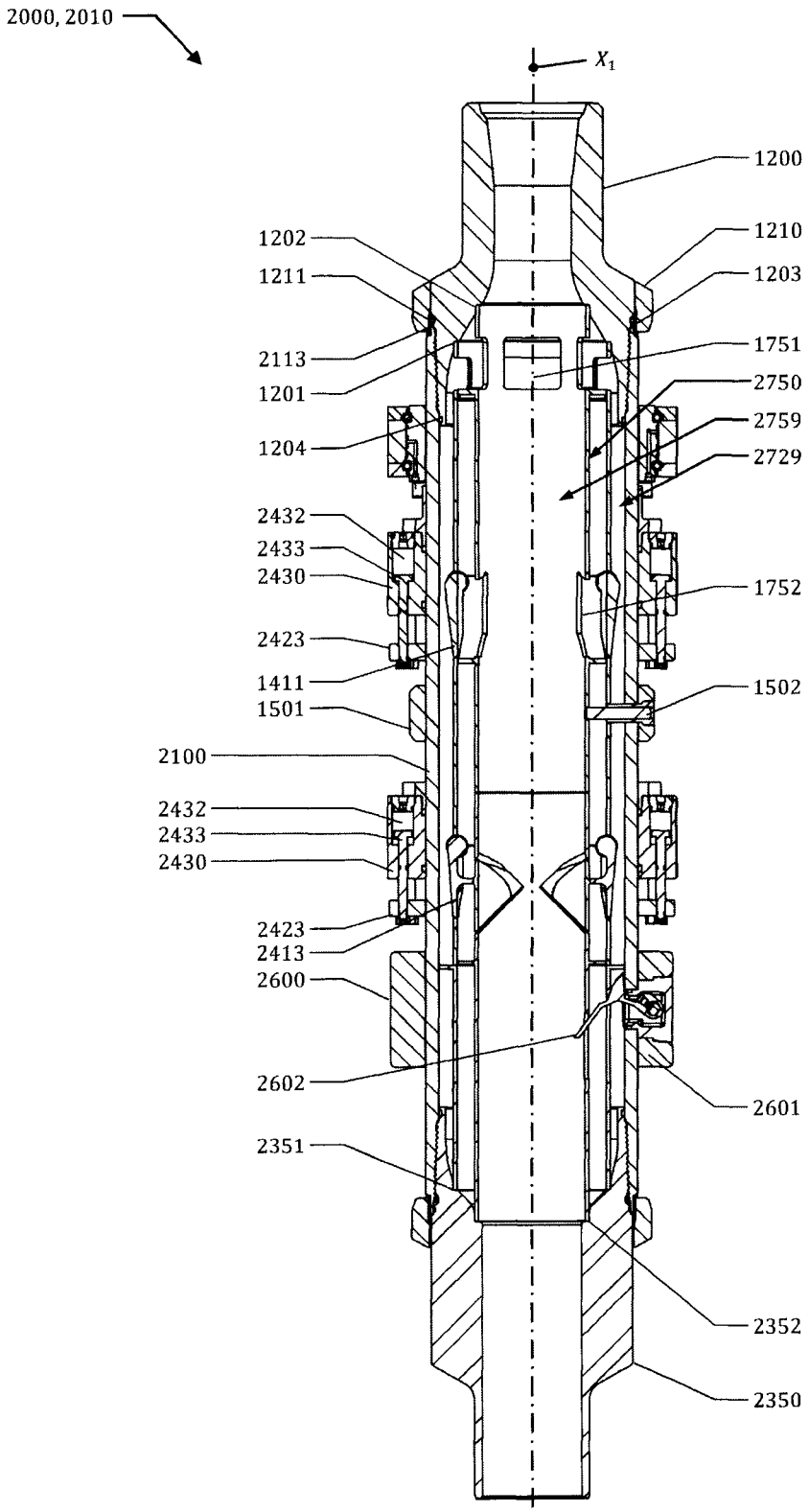
FIG. 10B is a longitudinal section through the plug launcher in FIG. 10A, shown with the upper and lower paddle valve subassemblies both in the launch position.

FIG. 10A illustrates plug launcher 2010 with a reduced-size (secondary) receiver cage 2750 and reduced-size paddles 2413 installed for launching lower balls and an upper plug for reduced-size casing, and showing upper and lower paddle valve subassemblies 2401 and 2402 both in the hold position. FIG. 10B illustrates the same tool with upper and lower paddle valve subassemblies 2401 and 2402 both in the launch position.

The upper end of secondary receiver cage 2750 is supported by stepped face 1202 of top cap 1200, and the lower end of secondary receiver cage 2750 is supported by stepped face 2351 of bottom cap 2350. Lower paddles 2412 are replaced by lower paddles 2413 configured to match secondary receiver cage 2750, and to effectively occlude secondary receiver cage bore 2759 to retain small articles.

Paddle Valve Subassemblies

Figure 11A:
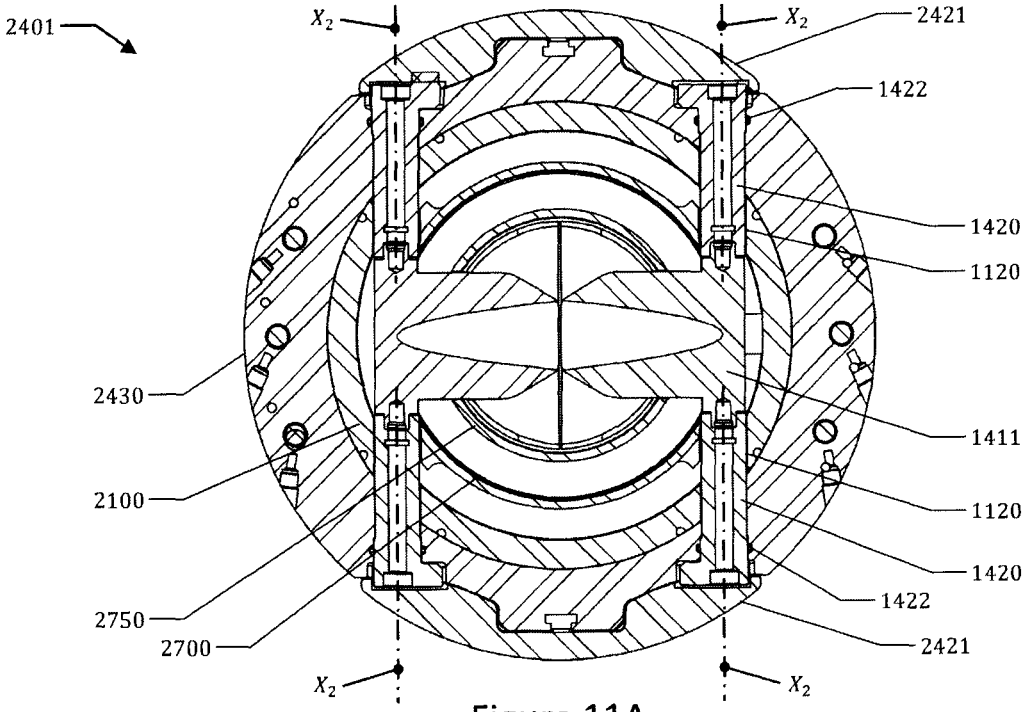
FIG. 11A is a transverse section through the plug launcher in FIG. 10A at the upper paddle valve subassembly, as seen in the hold position.
Figure 11B:
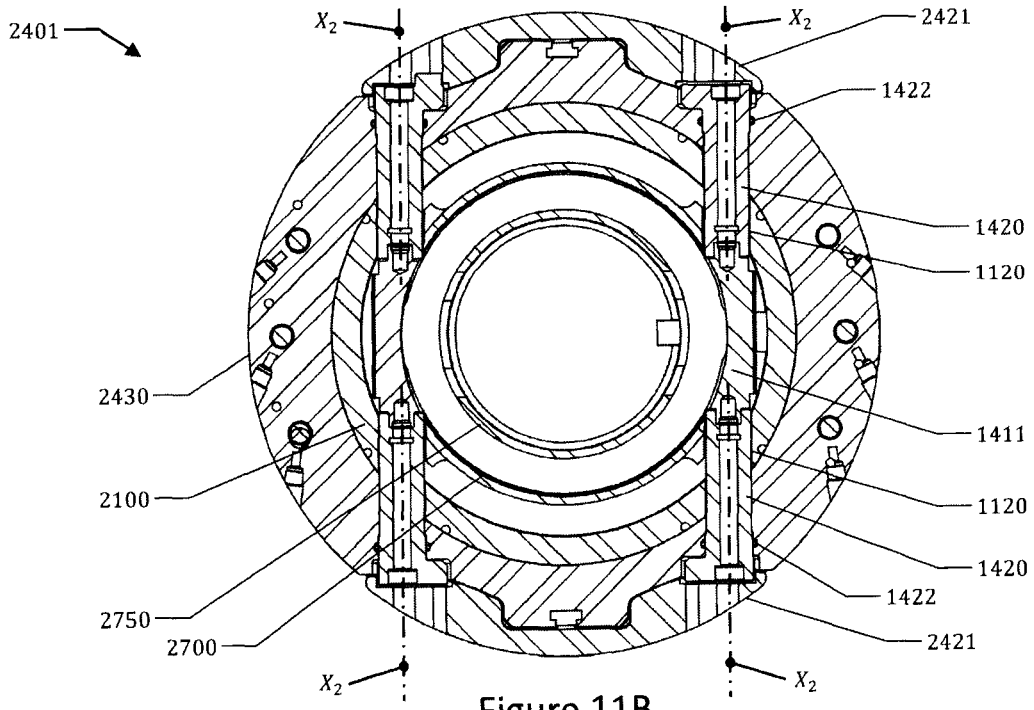
FIG. 11B is the transverse section as in FIG. 11A, but with the upper paddle valve subassembly shown in the launch position.
Figure 12A:
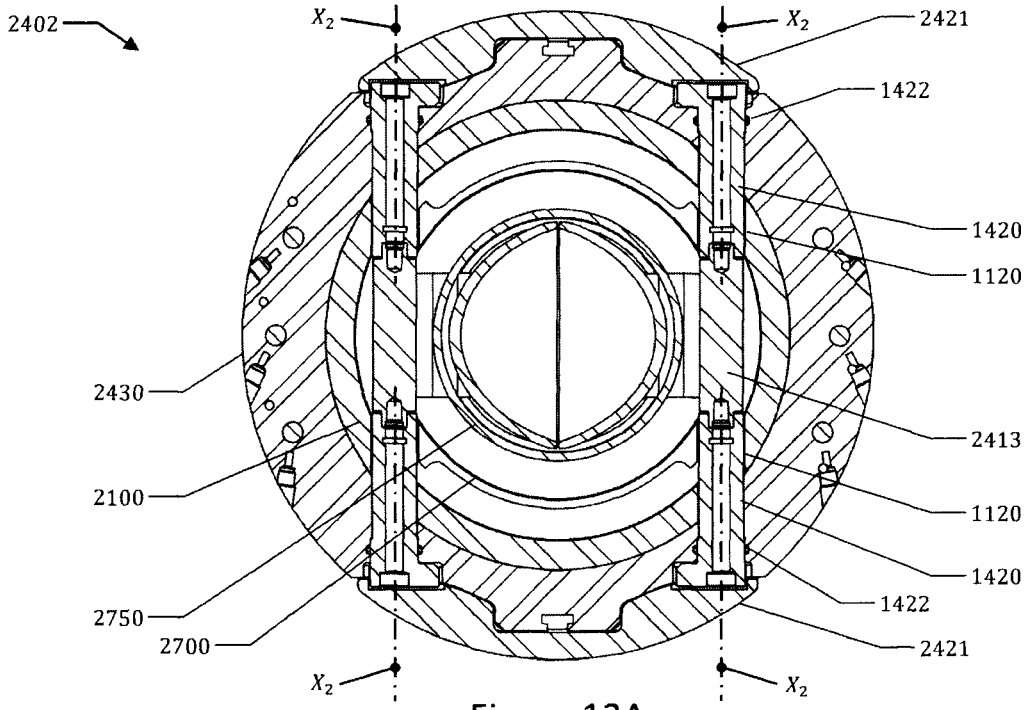
FIG. 12A is a transverse section through the plug launcher in FIG. 10A at the lower paddle valve subassembly, as seen in the hold position.
Figure 12B:
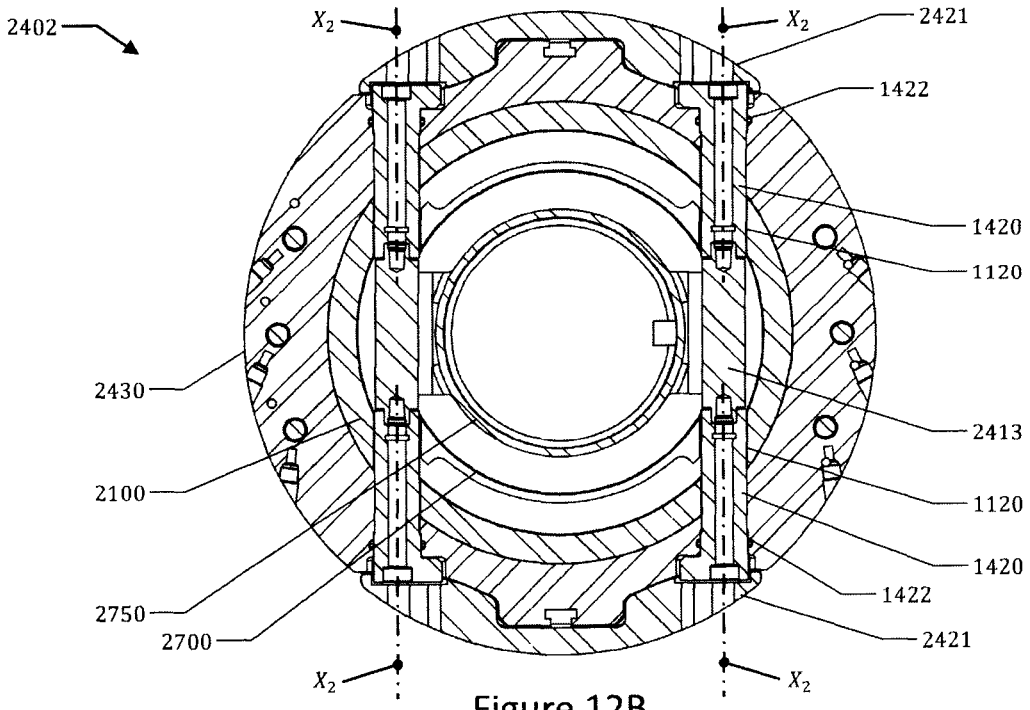
FIG. 12B is a transverse section as in FIG. 12A, but with the lower paddle valve subassembly shown in the launch position.

FIGS. 11A, 11B, 12A, and 12B are transverse sections through plug launcher 2010 having a reduced-size (secondary) receiver cage 2750 installed within base-size (primary) receiver cage 2700, and illustrating internal components and features of paddle valve subassemblies 2401 and 2402. FIGS. 11A and 11B show paddle valve subassembly 2401 with paddles 1411 in the hold and launch positions, respectively. FIG. 12A shows paddle valve subassembly 2402 with paddles 2413 in the hold position, and FIG. 12B shows paddle valve subassembly 2402 with paddles 2413 in the launch position.

In the illustrated embodiment, the fluid power actuation means used is integral to the paddle valve subassemblies. Support ring 2430 includes a plurality of double-acting cylinders 2432 (visible in FIGS. 8, 9A, 9B, 10A, and 10B) that are connected to the drilling rig via fluid swivel subassembly 2900. Pistons 2433 located within double-acting cylinders 2432 are mechanically connected to an actuation ring 2423 located below support ring 2430. Actuation ring 2423 transfers the force generated by the pistons to actuation track plates 2421. Track followers 2422 located on paddle shafts 1420 are constrained by curved slots in actuation track plates 2421, and axial movement of actuation track plates 2421 causes paddle shafts 1420 to rotate between the hold and launch positions.

Figure 7A:
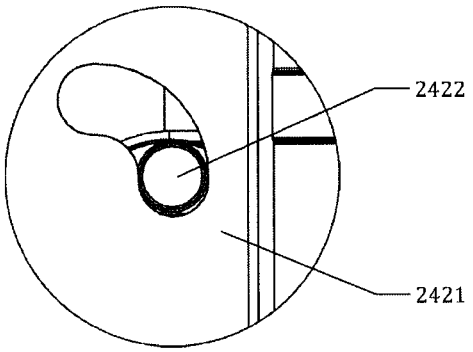
FIG. 7A is an enlarged elevation detail of the plug launcher in FIG. 5, illustrating the positions of the track followers and actuation track plates when the actuation means is in the hold position.
Figure 7B:
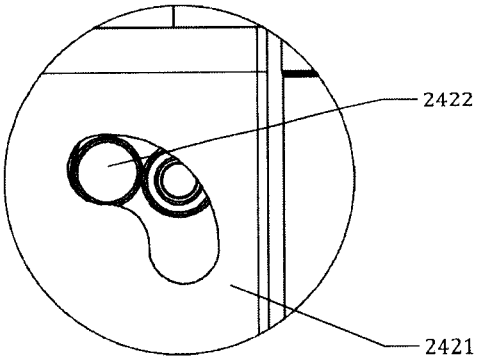
FIG. 7B is an enlarged elevation detail of the plug launcher in FIG. 5, illustrating the positions of the track followers and actuation track plates when the actuation means is in the launch position.
Figure 7C:
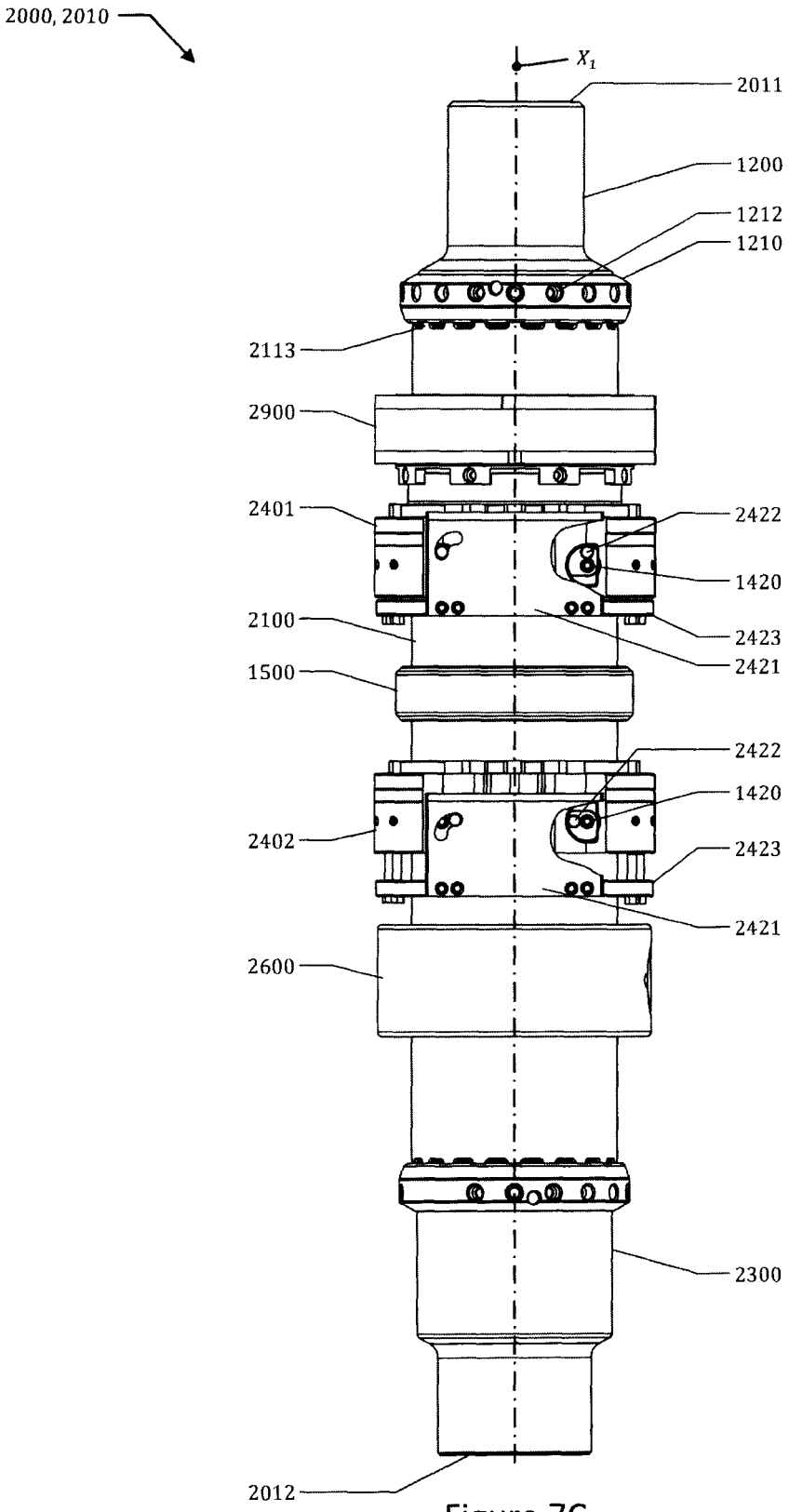
FIG. 7C is an elevation of the plug launcher in FIG. 5 with the actuation track plates partially cut away to more clearly illustrate the positions of the track followers and the paddle shafts in the hold and launch positions.

FIG. 7A shows the orientation of a track follower 2422 on rotatable paddle shaft 1420 within a slot in actuation track plate 2421 when the associated paddle valve subassembly is in the hold position. FIG. 7B shows the orientation of track follower 2422 on paddle shaft 1420 within the slot in track plate 2421 when the paddle valve subassembly is in the launch position. Other slot shapes are possible to provide different relationships between axial movement of actuation track plates 2421 and rotation of rotatable paddle shafts 1420, and to provide functionalities such as latching of the paddles in the hold and launch positions. Support ring 2430 includes geometric features to precisely guide actuation track plates 2421 to move parallel to the axes of double-acting cylinders 2432.

Figure 13A:
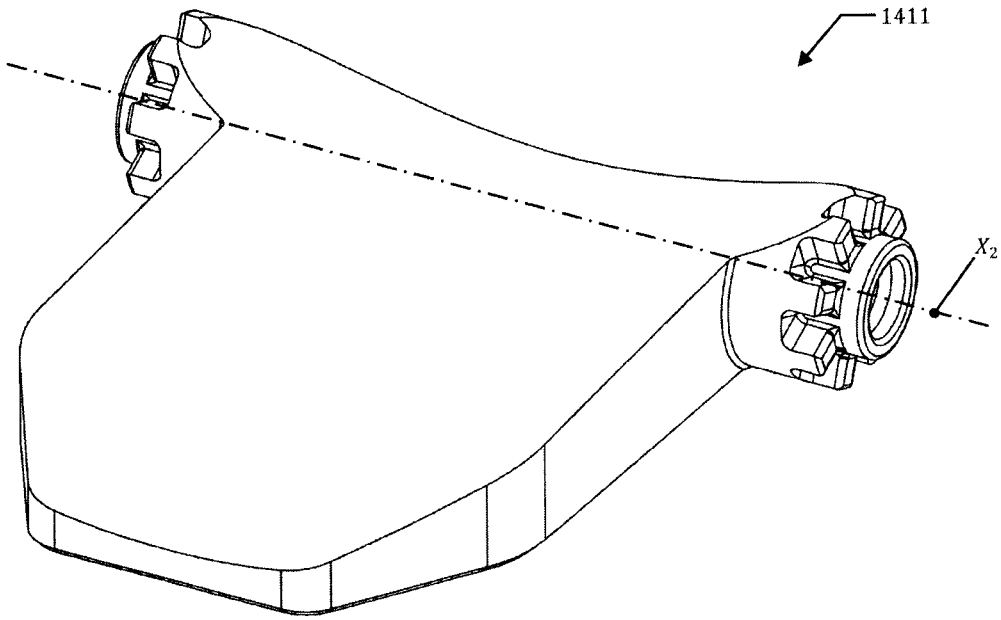
FIG. 13A is an isometric view of an embodiment of a paddle for a paddle valve subassembly configured to obstruct the bore of either a primary or secondary receiver cage to retain a plug when the paddle valve subassembly is in the hold position.

FIG. 13A is an isometric view of an embodiment 1411 of a paddle suitable for retaining and releasing articles that have a large transverse section relative to receiver bore 2709 or 2759, such as wiper plugs and darts.

Figure 13B:
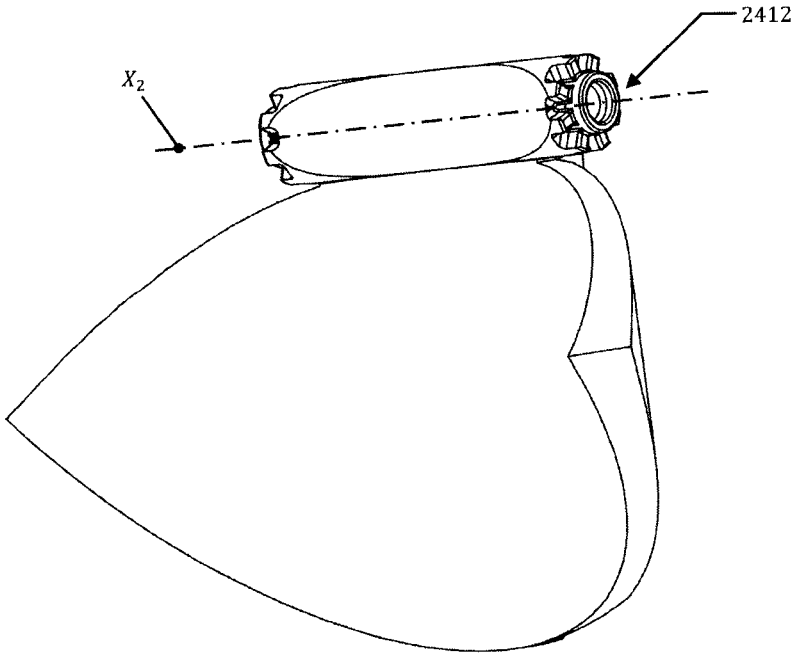
FIG. 13B is an isometric view of an embodiment of a paddle for a paddle valve subassembly configured to effectively occlude a base-size (primary) receiver cage bore to retain small articles (such as balls) when the paddle valve subassembly is in the hold position.

FIG. 13B is an isometric view of another embodiment 2412 of a paddle suitable for retaining and releasing articles that have a small transverse section relative to primary receiver bore 2709, such as balls. A pair of paddles 2412 mounted in plug launcher 2010 will effectively occlude the entirety of primary receiver bore 2709 when in the hold position.

Figure 13C:
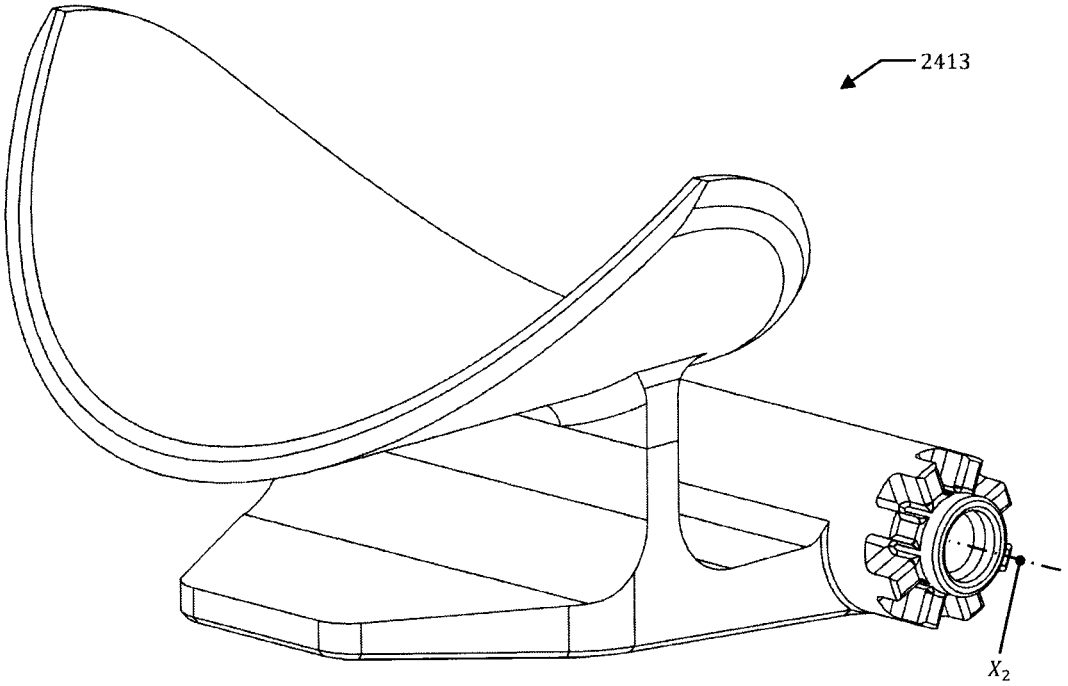
FIG. 13C is an isometric view of an embodiment of a paddle for a paddle valve subassembly configured to effectively occlude a reduced-size (secondary) receiver cage bore to retain small articles (such as balls) when the paddle valve subassembly is in the hold position.

FIG. 13C is an isometric view of another embodiment 2413 of a paddle suitable for retaining and releasing articles that have a small transverse section relative to secondary receiver cage bore 2759.

Fluid Swivel

Figure 14:
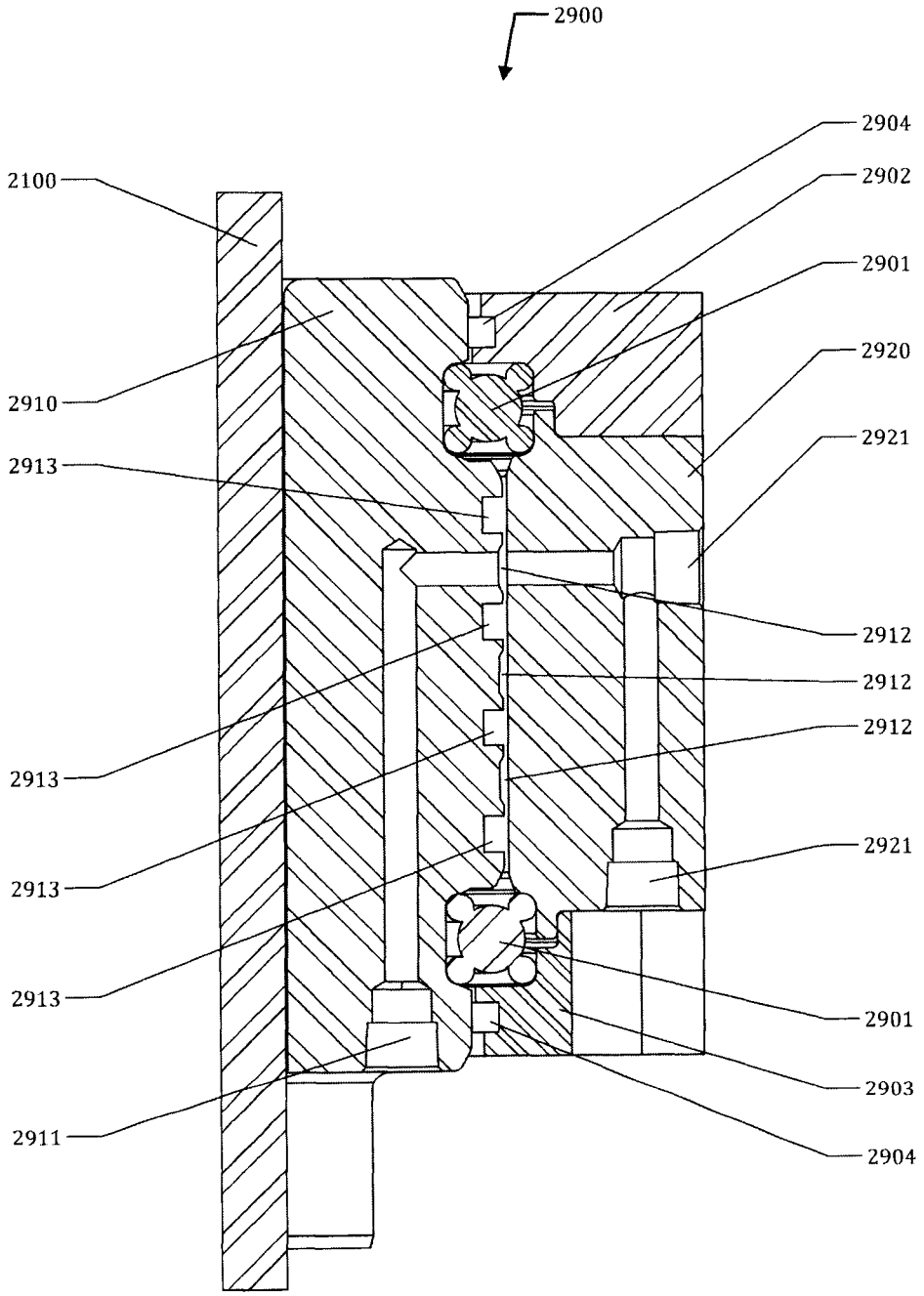
FIG. 14 is a longitudinal section through the fluid swivel subassembly of the plug launcher in FIG. 5.

FIG. 14 is a sectional detail of a fluid swivel subassembly 2900 of plug launcher 2010. In the illustrated embodiment, fluid swivel subassembly 2900 comprises an inner ring 2910 having three circumferential fluid channels 2912 that are isolated from each other and from the surrounding environment by a set of seal grooves 2913 with suitable sealing elements that seal against an outer ring 2920. Each fluid channel 2912 is in fluid communication with one or more ports 2911 in inner ring 2910 and with one or more ports 2921 in outer ring 2920. Fluid swivel subassembly 2900 allows fluid to flow between inner ring 2910 and outer ring 2920 to control the actuation means while the inner ring 2910 rotates relative to outer ring 2920. It will be apparent to a person of ordinary skill in the art that the number of fluid channels 2912 can be increased or decreased as may be necessary or desirable based on the number of paddle valve subassemblies, and whether the actuation of the two (or more) paddle valve subassemblies is linked or independent.

Inner ring 2910 is supported by launcher housing 2100 and secured thereto (such as by set screws). A pair of bearings 2901 enable relative rotation between inner ring 2910 and outer ring 2920 around plug launcher housing axis $X_1$. An upper bearing retaining ring 2902 and a lower bearing retaining ring 2903 are secured to outer ring 2920 by threaded fasteners to keep the parts of fluid swivel subassembly 2900 together. Debris seals are placed in grooves 2904 to protect the bearings from external contaminants.

Release Indicator Subassembly

Figure 15:
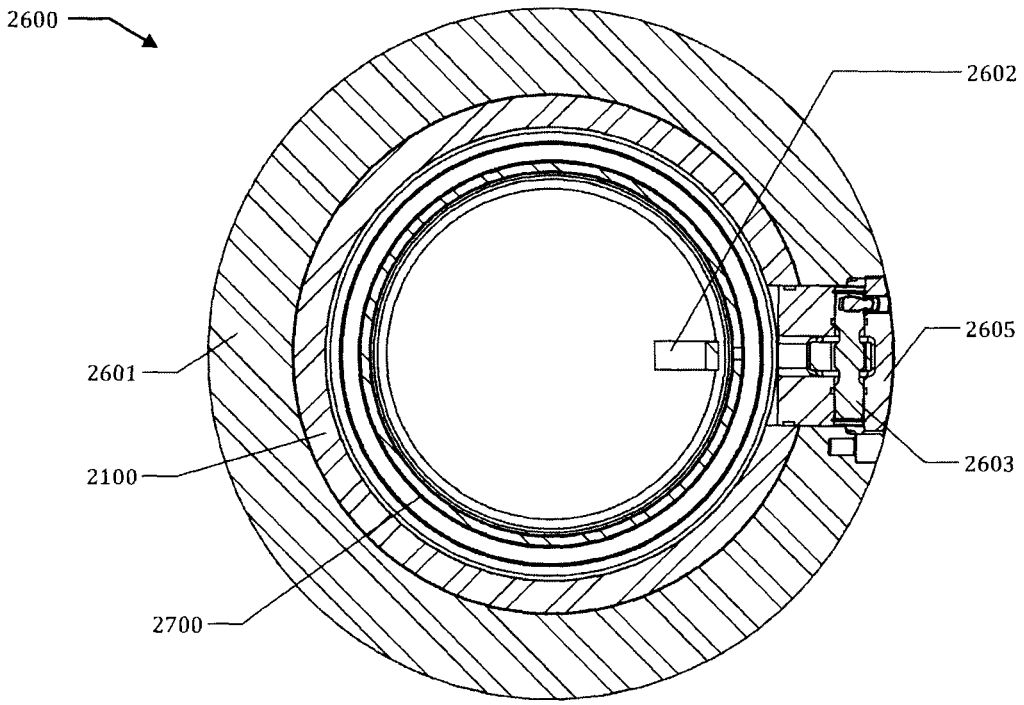
FIG. 15 is a transverse section through the plug launcher in FIG. 10A at the release indicator subassembly.

FIG. 15 is a transverse section through plug launcher 2010 at release indicator subassembly 2600. Release indicator support ring 2601 is close-fitting to and structurally supports launcher housing 2100 when plug launcher 2010 is internally pressurized. When a plug is launched by plug launcher 2010, the plug will push release indicator finger 2602 and cause a release indicator shaft assembly 2603 to rotate. A flag mounted to release indicator shaft 2603 and extending external to plug launcher 2010 will wave and give a visual indication that the plug has been launched. Release indicator shaft 2603 is positioned within support ring 2601 and retained therein by a release indicator holder 2605.

Plug launcher 1010 does not use a support ring for the release indicator 1600, and its launcher housing 1100 therefore requires a substantial wall thickness in the axial interval near release indicator 1600. Thus, when manufacturing launcher housing 1100 with machining tools, launcher housing 1100 must be made from solid bar stock or thick-walled tubular stock. In contrast, plug launcher 2010 uses a support ring 2601 in the release indicator subassembly 2600 and its launcher housing 2100 can be readily manufactured from a thin-walled tubular stock.

Actuation

Fluid pressure transferred via fluid swivel 2900 to the lower ends of double-acting cylinders 2432 within support ring 2430 will urge pistons 2433 and connected actuation ring 2423 and actuation track 2421 upwards, thereby rotating paddle shafts 1420 to urge paddles 1411, 2412, and 2413 toward the hold position. Fluid pressure transferred via fluid swivel 2900 to the upper ends of double-acting cylinders 2432 within support ring 2430 will urge pistons 2433 and connected actuation ring 2423 and actuation track 2421 downwards, thereby rotating paddle shafts 1420 to urge paddles 1411, 2412, and 2413 toward the launch position. The number and size of double-acting cylinders 2432 and pistons 2433 in support ring 2430 and the differential pressure applied between the upper and lower ends of double-acting cylinders 2432 are selected to ensure that sufficient force can be generated to reliably actuate paddles 1411, 2412, and 2413 between the hold and launch positions.

Fluid Flow and Plug Launching

It will be readily appreciated by persons of ordinary skill in the art that the sequence of fluid flow and plug launching for plug launchers 1010 and 2010 will be substantially the same.

Fluid Containment and Contaminant Protection

It will be readily appreciated by persons of ordinary skill in the art that containment of fluid pressure and protection from contamination by seal grooves with sealing elements within plug launchers 1010 and 2010 will be substantially the same.

Transferring Hoist and Torque Loads

It will be readily appreciated by persons of ordinary skill in the art that the transfer of hoist and torque loads of plug launchers 1010 and 2010 are substantially the same.

Configuration for Reduced-Size Plugs

For launching reduced-size plugs, secondary receiver cage 2750 is placed within plug launcher 2010 prior to installing top cap 1200 or bottom cap 2350 onto launcher housing 2100. Secondary receiver cage 2750 is held in place by stepped face 1202 of top cap 1200 and a stepped face 2352 of bottom cap 2350. Paddles 2412 are replaced by paddles 2413. The operation of plug launcher 2010 to launch reduced-size plugs is otherwise unchanged.

Additional Embodiments Including a Cement Swivel Tool

The embodiments of cementing head apparatus taught in the present disclosure may include a cement swivel tool and a plug launcher. The cementing head apparatus may be designed such that the cement swivel and the plug launcher are independently operable and can be disconnected from each other. Alternatively, the cementing head apparatus may be designed such that the cement swivel is integrated into the plug launcher such that the cement swivel and plug launcher must be assembled together as a single tool for operation.

Figure 16A:
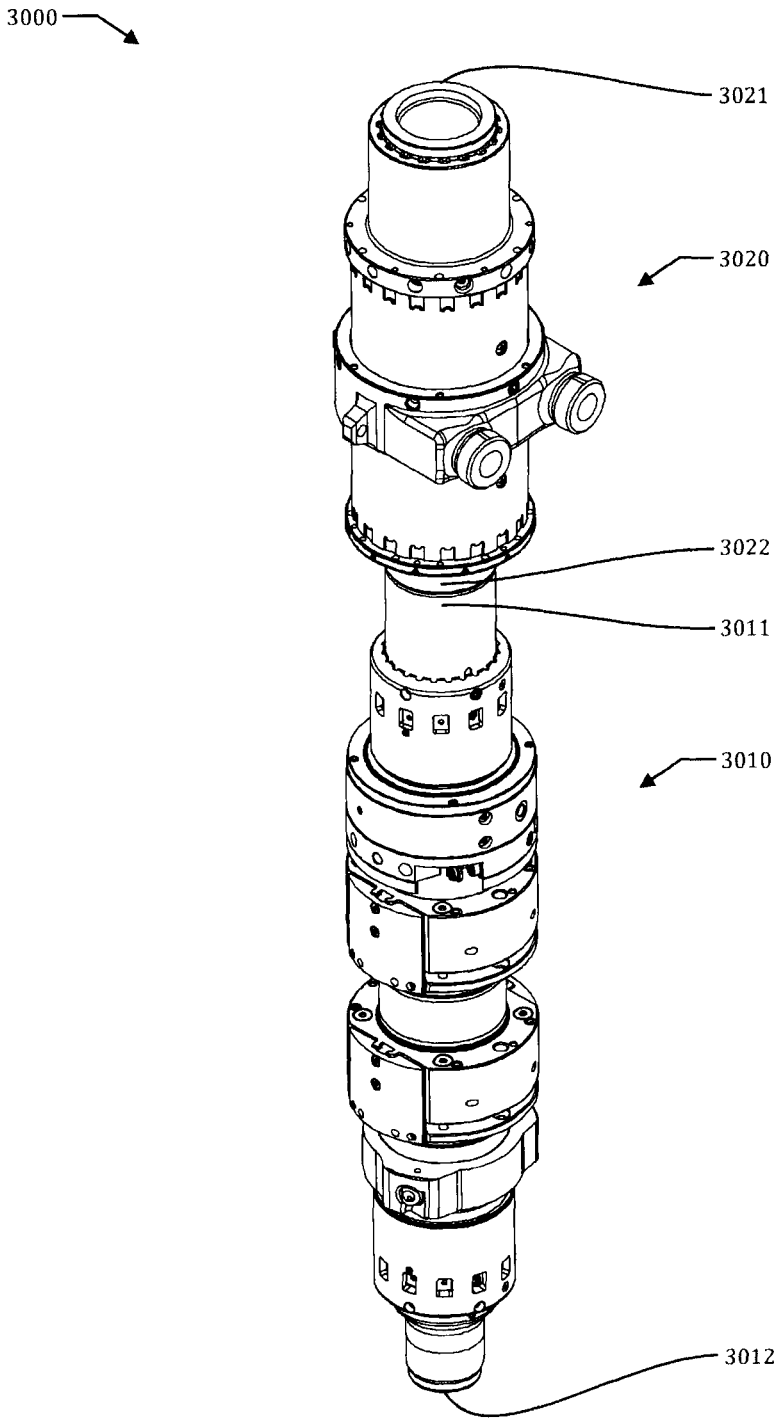
FIG. 16A is an isometric view of a further embodiment of a cementing head apparatus in accordance with the present disclosure, comprising a cement swivel tool attached to the upper end of a plug launcher.
Figure 16B:
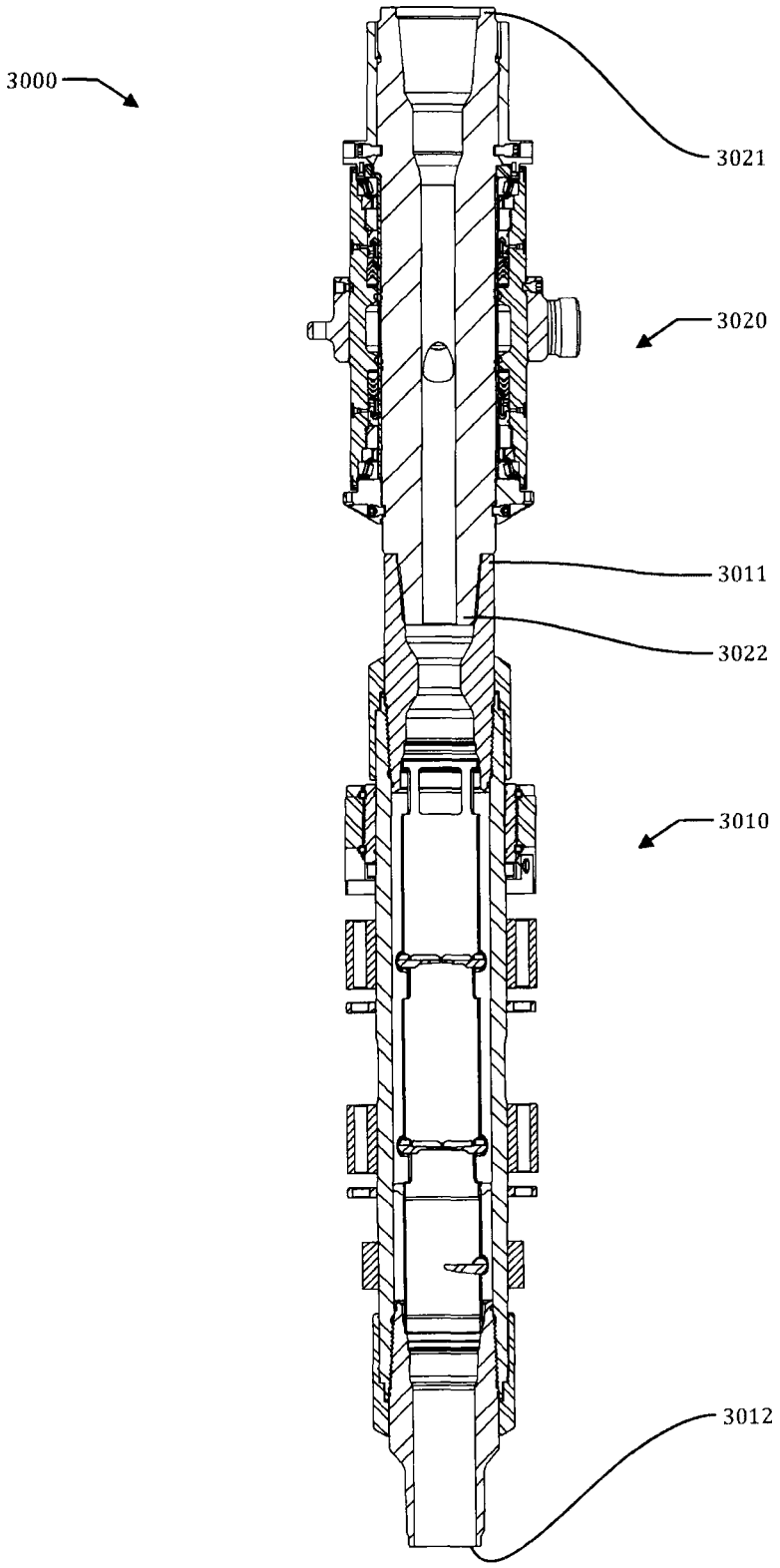
FIG. 16B is a longitudinal section through the cementing head apparatus in FIG. 16A.
Figure 17:
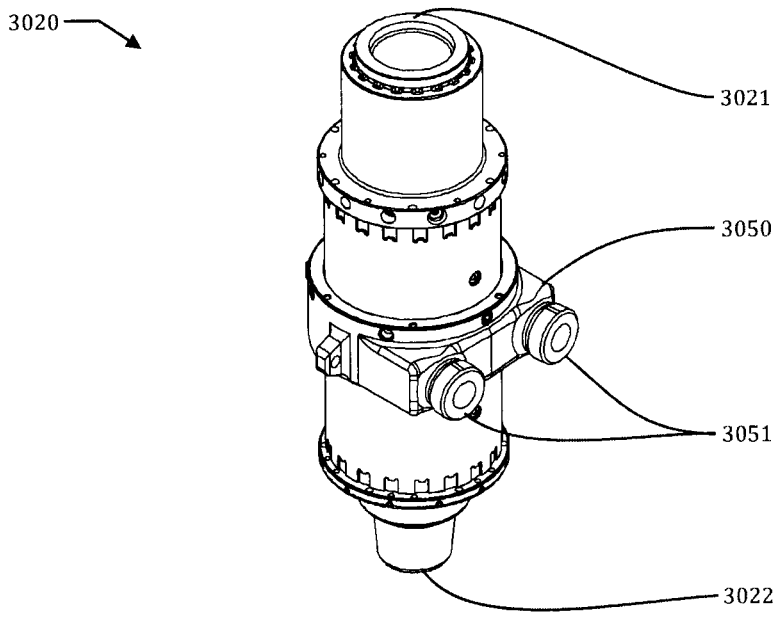
FIG. 17 is an isometric view of the cement swivel tool of the cementing head apparatus in FIG. 16A.

FIG. 16A is an isometric view of another embodiment 3000 of a cementing head apparatus in accordance with the present disclosure, comprising a cement swivel tool 3020 and a plug launcher 3010. FIG. 16B is a longitudinal section through cementing head apparatus 3000. Plug launcher 3010 has an upper end 3011 and a lower end 3012. Cement swivel tool 3020 has an upper end 3021 and a lower end 3022. Lower end 3022 of cement swivel tool 3020 sealingly engages upper end 3011 of plug launcher 3010 by means of a threaded connection. Cement swivel tool 3020 may be separated from plug launcher 3010 and operated independently from plug launcher 3010 as shown in FIG. 17, which is an isometric view of cement swivel tool 3020.

Figure 19:
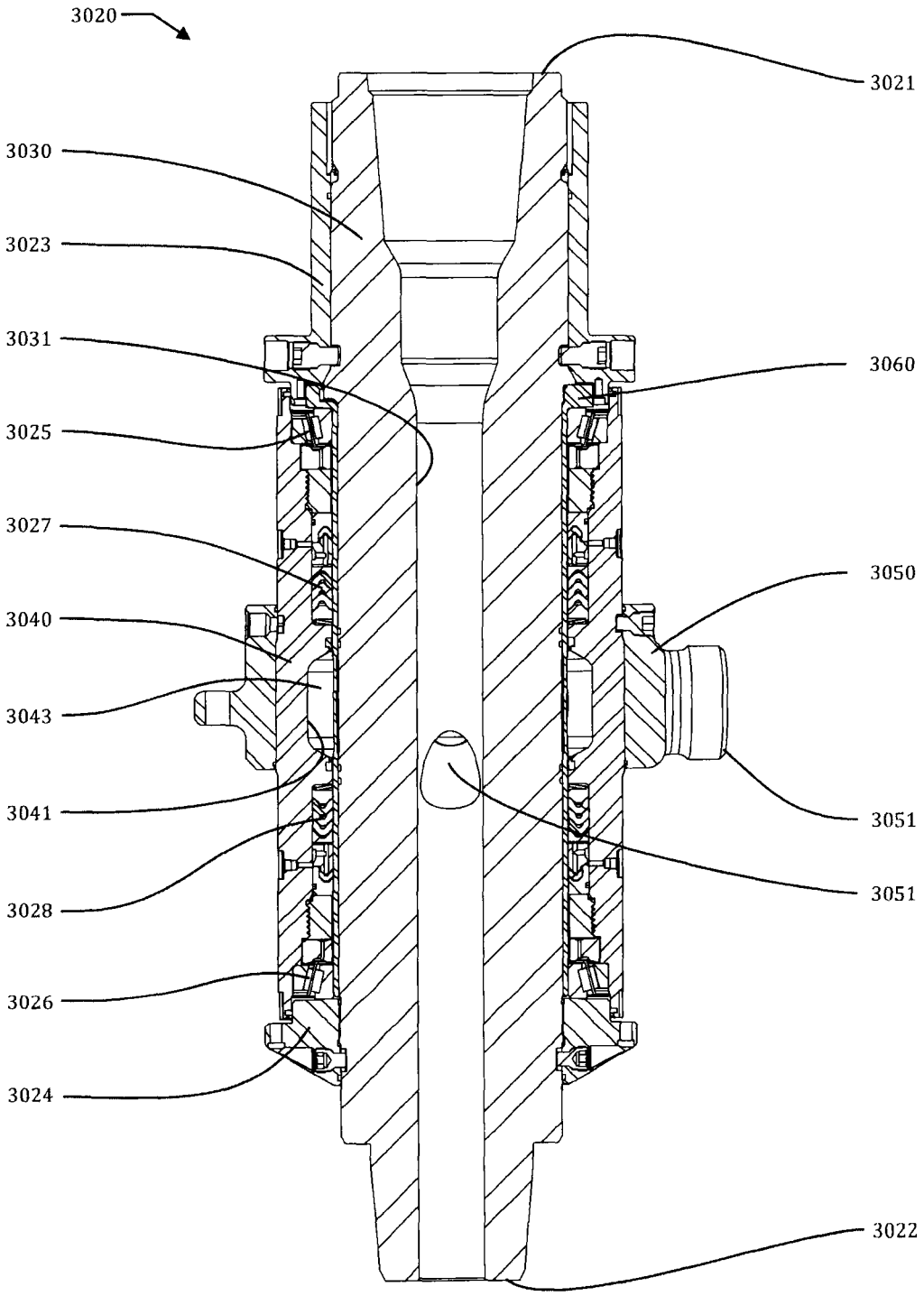
FIG. 19 is a longitudinal section through the cement swivel tool in FIG. 17.

FIG. 19 is a longitudinal section through cement swivel tool 3020. Cement swivel tool 3020 comprises:

- a generally axisymmetric mandrel 3030 having a mandrel bore 3031;
- a generally axisymmetric swivel housing 3040 having a profiled swivel housing bore 3041;
- a support ring 3050 having two connections 3051 adapted by any suitable means to sealingly engage with fluid flow lines from a drilling rig;
- a generally axisymmetric lock sleeve 3023;
- a generally axisymmetric bottom cap 3024;
- a generally axisymmetric mandrel sleeve 3060;
- upper bearing 3025 and lower bearing 3026; and
- upper dynamic seal assembly 3027 and lower dynamic seal assembly 3028.

Figure 18:
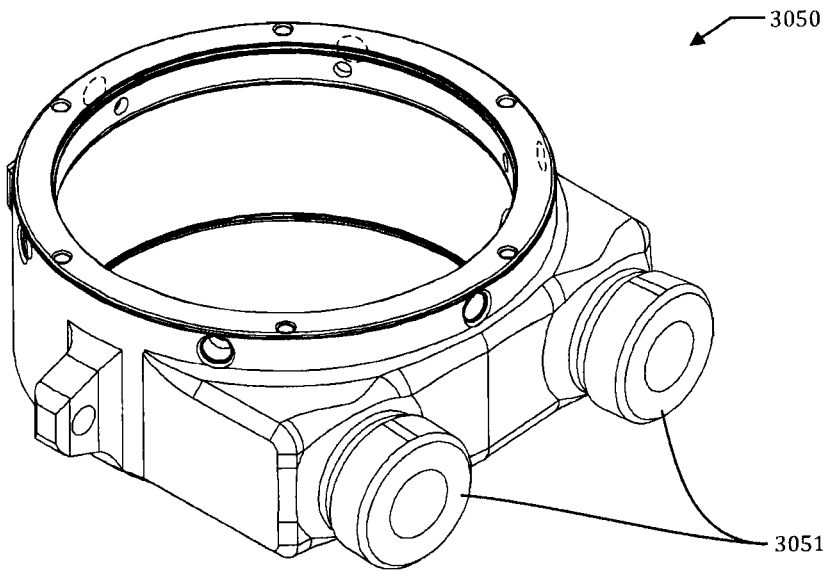
FIG. 18 is an isometric view of the support ring of the cement swivel tool in FIG. 17.
Figure 20:
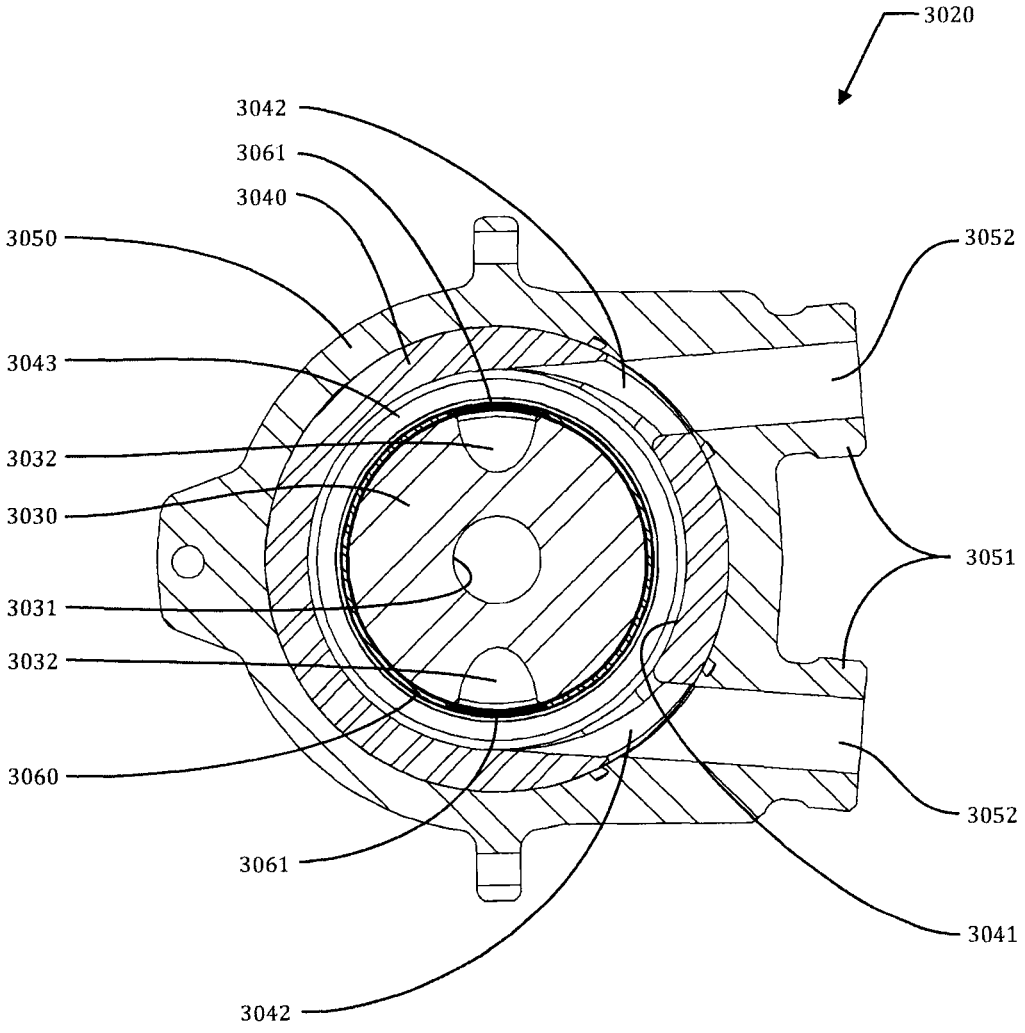
FIG. 20 is a transverse section through the cement swivel tool in FIG. 17 at the support ring subassembly.

FIG. 18 is an isometric view of support ring 3050, and FIG. 20 is a transverse section through cement swivel tool 3020 at support ring 3050.

Lock sleeve 3023 is secured to mandrel 3030 by a set of lugs. Mandrel sleeve 3060 is coaxially and sealingly disposed around mandrel 3030 and secured to lock sleeve 3023 by a set of machine screws, and thus is axially and rotationally fixed to mandrel 3030. The side ports 3061 of mandrel sleeve 3060 are aligned with side ports 3032 of mandrel 3030 which connect to mandrel bore 3031.

Swivel housing 3040 is coaxially and sealingly disposed around mandrel sleeve 3060. Swivel housing 3040 is axially located between upper bearing 3025 and lower bearing 3026 which are held by the upper end of mandrel sleeve 3060 and bottom cap 3026. Bearings 3025 and 3026 permit relative rotation between swivel housing 3040 and mandrel sleeve 3060.

Support ring 3050 is sealingly disposed around swivel housing 3040 and secured to swivel housing 3040 by a set of lugs. Fluid channels 3052 in support ring 3050 transfer cement slurry and other fluids between the drilling rig flow lines and the side ports 3042 of swivel housing 3040. An annular fluid channel 3043 is formed between the profile bore of swivel housing 3040 and the outside surface of mandrel sleeve 3060, and provides fluid communication between swivel housing side ports 3042 and mandrel sleeve side ports 3061. Thus, fluid may flow between the drilling rig flow lines and mandrel bore 3031 via channels 3052, swivel housing side ports 3042, fluid channel 3043, mandrel sleeve side ports 3061, and side ports 3032.

Figure 21A:
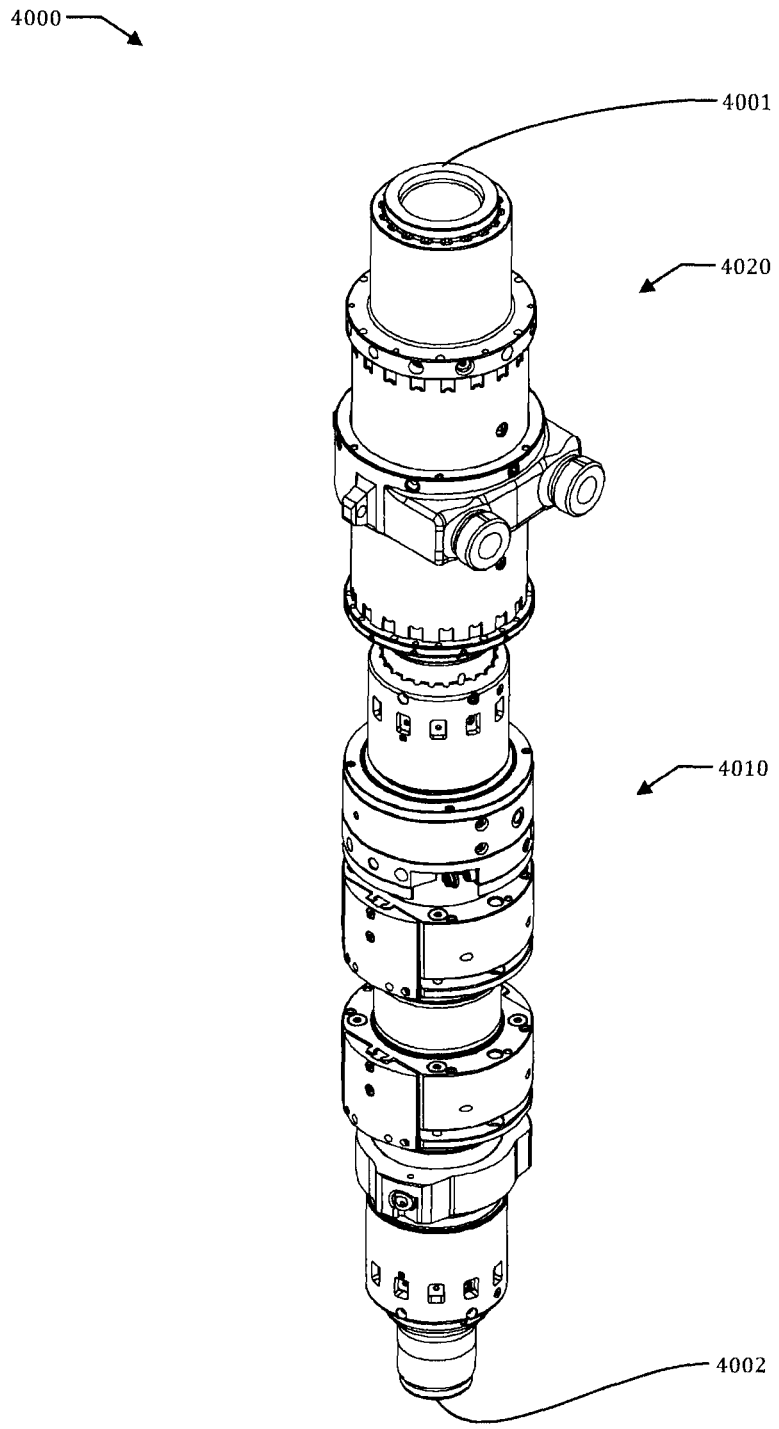
FIG. 21A is an isometric view of a variant embodiment of the cementing head apparatus in FIG. 16A, in which the cement swivel tool is integral with the plug launcher, and the mandrel of the cement swivel tool is adapted to function as the top cap of the plug launcher.
Figure 21B:
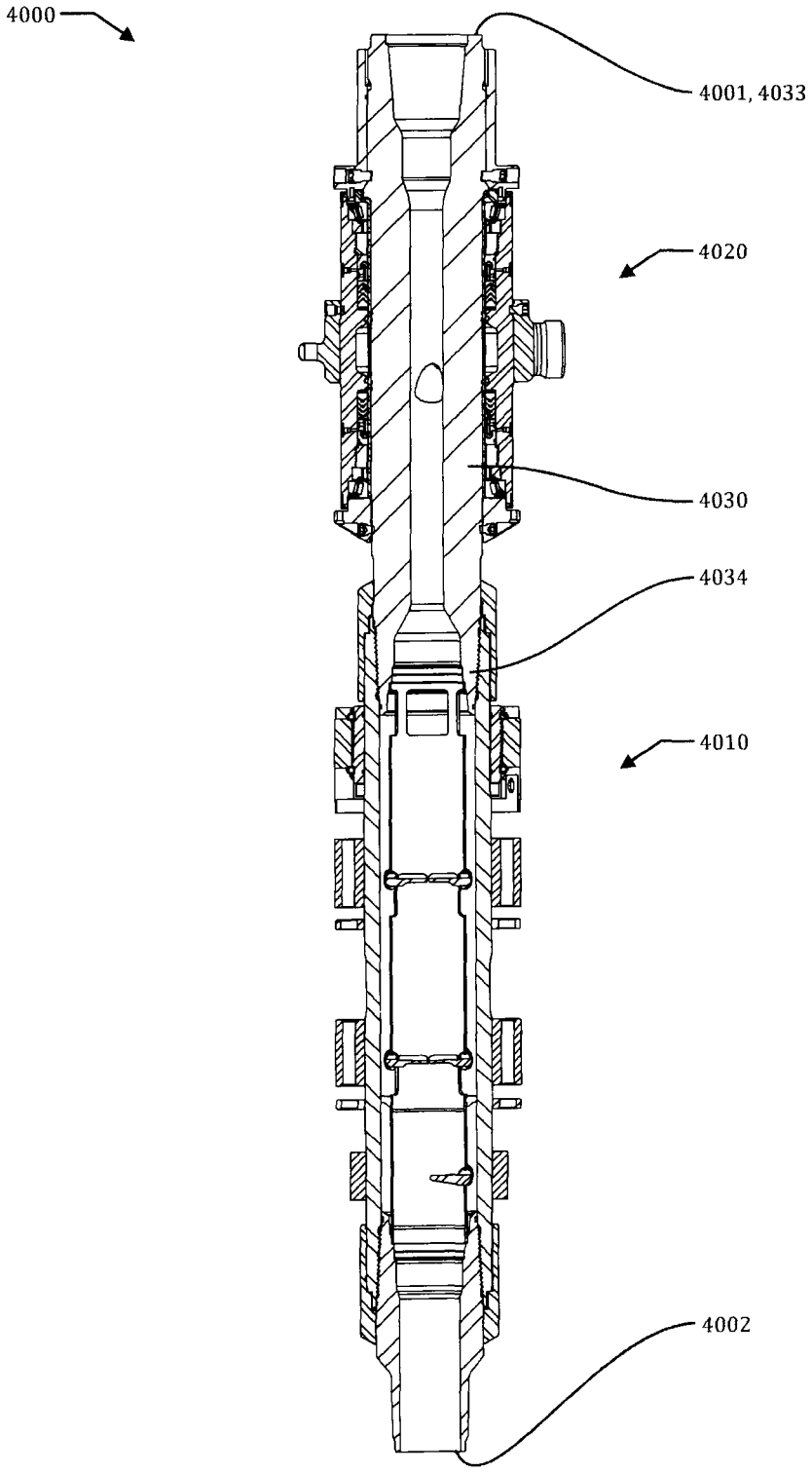
FIG. 21B is a longitudinal section through the cementing head apparatus in FIG. 21A.

FIG. 21A is an isometric view of another embodiment 4000 of a cementing head apparatus in accordance with the present disclosure, consisting of a cement swivel tool 4020 integral with a plug launcher 4010. FIG. 21B is a longitudinal section through cementing head apparatus 4000. Cement swivel tool 4020 has a mandrel 4030 with an upper end 4033 and a lower end 4034. Lower end 4034 is adapted to function as the top cap of plug launcher 4010. Cement swivel tool 4020 is otherwise identical cement swivel tool 3020.

It will be readily appreciated by persons of ordinary skill in the art that various modifications to embodiments in accordance with the present disclosure may be devised without departing from the scope of the present teachings, including modifications which may use equivalent structures or materials hereafter conceived or developed, or to retain and release a different number of plugs, such as by changing the length of the launcher housing and the number of paddle valve subassemblies.

It is to be especially understood that the scope of the present disclosure is not intended to be limited to described or illustrated embodiments, and that the substitution of a variant of a claimed or illustrated element or feature, without any substantial resultant change in functionality, will not constitute a departure from the scope of the disclosure.

Although certain elements and features of disclosed embodiments are described and illustrated in this document in the specific contexts of cementing head apparatus and plug launchers, such features and elements may be readily adapted for use in other and different technological and operational contexts without departing from the intended scope of the present disclosure. For one non-limiting example, support rings such as those described herein as being mounted to the housing of a plug launcher housing or a cement swivel assembly could adapted for mounting on pipelines or other conduits or vessels containing or transporting pressurized liquid or gaseous fluids, and adapted and configured for operational purposes specific to such conduits or vessels.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element.

Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure.

Relational and conformational terms such as "perpendicular", "parallel", "coaxial", "axisymmetric", "coextensive", and "cylindrical" are not intended to denote or require absolute mathematical or geometrical precision. Accordingly, such terms are to be understood as denoting or requiring substantial precision only (e.g., "substantially perpendicular" or "generally cylindrical") unless the context clearly requires otherwise. In addition, and unless specifically noted otherwise, any reference to an element being "tubular" or "generally tubular" is intended to denote that the element in question would appear substantially cylindrical in transverse cross-section, although the cross-sectional configuration of the element might vary along its length.

Wherever used in this document, the terms "typical" and "typically" are to be interpreted in the sense of representative of common usage or practice, and are not to be understood as implying essentiality or invariability.

LIST OF COMPONENTS AND FEATURES

Feature Number Description
- 1010 plug-launching tool
- 1011 plug-launching tool upper end
- 1012 plug-launching tool lower end
- 1100 launcher housing
- 1100L launcher housing lower end
- 1100U launcher housing upper end
- 1101 launcher housing base-size (primary) receiver cage stepped face
- 1109 launcher housing bore
- 1111 launcher housing upper end thread
- 1112 launcher housing lower end thread
- 1113 launcher housing external spline section
- 1114 launcher housing lower end seal groove
- 1115 launcher housing wall
- 1120 launcher housing through-wall valve opening
- 1150 launcher housing through-wall inspection port opening
- 1160 launcher housing through-wall release indicator opening
- 1200 top cap
- 1201 top cap base-size (primary) receiver cage stepped face
- 1202 top cap reduced-size (secondary) receiver cage stepped face
- 1203 top cap thread upper seal groove
- 1204 top cap thread lower seal groove
- 1210 top cap lock sleeve
- 1211 top cap lock sleeve splined section
- 1212 top cap lock sleeve lug
- 1300 bottom cap
- 1310 bottom cap lock sleeve
- 1311 bottom cap lock sleeve splined section
- 1312 bottom cap lock sleeve lug Feature Number Description
- 1313 bottom cap lock sleeve upper seal groove
- 1314 bottom cap lock sleeve lower seal groove
- 1350 bottom cap for reduced-size casing
- 1351 bottom cap reduced-size (secondary) receiver cage stepped face
- 1401 upper paddle valve subassembly
- 1402 lower paddle valve subassembly
- 1411 paddle
- 1420 rotatable shaft
- 1421 rotatable shaft position latch
- 1422 rotatable shaft seal groove
- 1430 paddle valve support ring for manual release
- 1431 paddle valve support ring seal groove
- 1500 inspection port subassembly
- 1501 inspection port support ring
- 1502 inspection port sight glass
- 1503 inspection port sight glass holder
- 1504 inspection port seal groove
- 1600 release indicator
- 1602 release indicator finger
- 1603 release indicator shaft assembly
- 1604 release indicator seal groove
- 1605 release indicator internal seal groove
- 1700 base-size (primary) receiver cage
- 1701 base-size (primary) receiver cage upper port
- 1702 base-size (primary) receiver cage lower port for upper plug
- 1703 base-size (primary) receiver cage lower port for lower plug
- 1709 base-size (primary) receiver bore
- 1710 base-size (primary) receiver upper section
- 1719 base-size (primary) receiver cage wall
- 1720 base-size (primary) receiver middle section Feature Number Description
- 1729 receiver annulus
- 1730 base-size (primary) receiver lower section
- 1750 reduced-size (secondary) receiver cage
- 1751 reduced-size (secondary) receiver cage upper port
- 1752 reduced-size (secondary) receiver cage lower port for upper plug
- 1753 reduced-size (secondary) receiver cage lower port for lower plug
- 1759 reduced-size (secondary) receiver cage bore
- 2010 plug-launching tool with fluid actuation
- 2011 plug-launching tool upper end

2012 plug-launching tool lower end
2100 launcher housing
2300 bottom cap
2301 bottom cap receiver cage stepped face
2350 bottom cap for reduced-size casing
2351 bottom cap base-size (primary) receiver cage stepped face
2352 bottom cap reduced-size (secondary) receiver cage stepped face
2401 upper paddle valve subassembly for fluid actuation
2402 lower paddle valve subassembly for fluid actuation
2412 bore-occluding paddle for base-size (primary) receiver cage
2413 bore-occluding paddle for reduced-size (secondary) receiver cage
2421 paddle valve track plate
2422 paddle valve track followers
2423 paddle valve actuation ring
2430 paddle valve support ring for fluid actuation
2432 double-acting cylinder
2433 Pistons
2600 release indicator subassembly
2601 release indicator support ring
2602 release indicator finger
Feature Number Description
2603 release indicator shaft
2605 release indicator holder
2700 base-size (primary) receiver cage
2703 base-size (primary) receiver cage lower port for bore-occluding paddle
2709 receiver bore
2710 base-size (primary) receiver cage upper section
2719 base-size (primary) receiver cage wall
2720 base-size r(primary) eceiver cage middle section
2729 receiver annulus
2730 base-size (primary) receiver cage lower section
2750 reduced-size (secondary) receiver cage
2900 fluid swivel subassembly
2901 swivel bearing
2902 swivel upper bearing retaining ring
2903 swivel lower bearing retaining ring
2904 swivel debris seal groove
2910 swivel inner ring
2911 swivel inner ring port
2912 swivel fluid channels
2913 swivel seal groove
2920 swivel outer ring
2921 swivel outer ring port
3000 cementing head apparatus
3010 plug-launching tool
3011 plug-launching tool upper end
3012 plug-launching tool lower end
3020 cement swivel tool
3021 cement swivel tool upper end
3022 cement swivel tool lower end
Feature Number Description
3025 upper bearing
3026 lower bearing
3027 upper dynamic seal assembly
3028 lower dynamic seal assembly
3030 cement swivel mandrel
3031 mandrel bore
3032 mandrel side port
3040 cement swivel housing
3041 swivel housing bore
3042 swivel housing side port
3043 annular fluid channel between swivel housing and mandrel sleeve
3050 support ring
3051 connection for fluid flow line
3052 fluid channel
3023 lock sleeve
3024 bottom cap
3060 mandrel sleeve
3061 mandrel sleeve side port
4000 cementing head apparatus
4010 plug-launching tool
4020 cement swivel tool
4030 cement swivel mandrel
4033 cement swivel mandrel upper end
4034 cement swivel mandrel lower end The embodiments in which an exclusive property or privilege is claimed are defined as follows:

1. A cementing head apparatus including a plug launcher, wherein the plug launcher comprises:

(a) an axisymmetric launcher housing having an upper end, a lower end, a launcher housing bore, a launcher housing wall, and a launcher housing axis;

(b) one or more paddle shafts mounted to the plug launcher such that each of said one or more paddle shafts is rotatable about an associated paddle shaft axis that is perpendicular to, but transversely offset from, the launcher housing axis;

(c) one or more paddles, wherein each of said one or more paddles is coupled to an associated one of the one or more paddle shafts, and thereby to be selectively movable, by selective rotation of the one or more paddle shafts, between:

a hold position, in which the one or more paddles extend into the launcher housing bore so as to retain a selected plug positioned within the launcher housing bore; and a launch position, in which the one or more paddles are sufficiently retracted from the hold position such that the paddles do not restrict passage of the plug through the launcher housing bore; and (d) paddle actuation means for selectively rotating the one or more paddle shafts and thereby enabling selectively progressive movement of the one or more paddles from the hold position toward the launch position.

2. A cementing head apparatus as in claim 1 wherein the one or more paddles substantially occlude the launcher housing bore when the one or more paddles are in the hold position.

3. A cementing head apparatus as in claim 1, wherein the plug launcher further comprises an axisymmetric primary receiver cage having an upper end, a lower end, a primary receiver bore, and a primary receiver wall, said primary receiver cage being disposed within the launcher housing bore and defining a primary receiver annulus between the primary receiver cage and the launcher housing bore.

4. A cementing head apparatus as in claim 3, wherein the primary receiver cage is coaxial with the launcher housing.

5. A cementing head apparatus as in claim 3, wherein the primary receiver cage has one or more upper primary receiver cage ports and one or more lower primary receiver cage ports extending through the primary receiver wall, with an unported primary receiver cage interval between the upper and lower primary receiver cage ports defining a primary retained plug interval.

6. A cementing head apparatus as in claim 5, wherein the one or more paddles at least partially occlude the lower primary receiver cage ports when the one or more paddles are in the launch position.

7. A cementing head apparatus as in claim 6, wherein the plug launcher further includes sealing elements on the lower primary receiver cage ports that seal against the one or more paddles when the one or more paddles are in the launch position.

8. A cementing head apparatus as in claim 6, wherein the plug launcher further includes sealing elements on the one or more paddles that seal against the lower primary receiver cage ports when the one or more paddles are in the launch position.

9. A cementing head apparatus as in claim 3, wherein the one or more paddles substantially occlude the primary receiver bore when the one or more paddles are in the hold position.

10. A cementing head apparatus as in claim 3, wherein the plug launcher further comprises:

(a) a secondary receiver cage having a secondary receiver bore and a secondary receiver wall; and (b) one or more upper secondary receiver cage ports and one or more lower secondary receiver cage ports extending through the secondary receiver wall: and wherein:

(c) the secondary receiver cage is disposed within the primary receiver bore; and (d) the one or more paddles extend through the lower secondary receiver cage ports and into the secondary receiver bore when the one or more paddles are in the hold position.

11. A cementing head apparatus as in claim 10, wherein the secondary receiver cage is coaxial with the primary receiver cage.

12. A cementing head apparatus as in claim 10, wherein the one or more paddles substantially occlude the secondary receiver bore when the one or more paddles are in the hold position.

13. A cementing head apparatus as in claim 10, wherein the one or more paddles at least partially occlude the lower secondary receiver cage ports in the secondary receiver wall when the one or more paddles are in the launch position.

14. A cementing head apparatus as in claim 13, wherein the plug launcher further includes sealing elements on the lower secondary receiver cage ports that seal against the one or more paddles when the one or more paddles are in the launch position.

15. A cementing head apparatus as in claim 13, wherein the plug launcher further includes sealing elements on the one or more paddles that seal against the lower secondary receiver cage ports when the one or more paddles are in the launch position.

16. A cementing head apparatus as in claim 3, wherein the paddle actuation means also enables selectively progressive movement of the one or more paddles from the launch position toward the hold position.

17. A cementing head apparatus as in claim 1, wherein the one or more paddle shafts are manually rotatable.

18. A cementing head apparatus as in claim 1, wherein the paddle actuation means includes apparatus selected from the group consisting of:

(a) a mechanical linkage configured to convert linear movement of one or more fluid-actuated pistons to rotation of the one or more paddle shafts;

(b) a gear system configured to convert linear movement of one or more fluid-actuated pistons to rotation of the one or more paddle shafts; and (c) a fluid-actuated motor to cause rotation of the one or more paddle shafts.

19. A cementing head apparatus as in claim 18, wherein the plug launcher further comprises fluid swivel means for facilitating delivery of actuating fluid to the paddle actuation means while the plug launcher is being rotated by a drilling rig.

20. A cementing head apparatus as in claim 1, wherein the paddle actuation means includes an electric motor to cause rotation of the one or more paddle shafts.

21. A cementing head apparatus as in claim 1, wherein the plug launcher further comprises one or more support rings circumferentially mounted to the launcher housing and sealingly coupled in at least one region of the interface between the support ring and the launcher housing so as to provide access to the interior of the housing with fluid containment.

22. A cementing head apparatus as in claim 21, wherein at least one of the one or more support rings incorporates one or more components of the paddle actuation means.

23. A cementing head apparatus as in claim 21, wherein at least one of the one or more support rings is designed to structurally reinforce the launcher housing.

24. A cementing head apparatus as in claim 1, further including a cement swivel assembly mounted to the upper end of the launcher housing, said cement swivel assembly comprising:

(a) an axisymmetric swivel housing having a swivel housing bore and one or more swivel housing side ports;

(b) an axisymmetric mandrel having a cylindrical outer surface, a cylindrical mandrel bore, and one or more mandrel side ports in fluid communication with the mandrel bore, wherein:

the mandrel is coaxially disposed within the swivel housing bore;

the swivel housing bore sealingly engages the cylindrical outer surface of the mandrel to contain fluid pressure within the cement swivel assembly; and an annular flow channel is formed between the outer surface of the mandrel and the swivel housing bore, enabling fluid flow between the swivel housing side ports and the one or more mandrel side ports;

(c) two or more bearing elements permitting free relative rotation between the mandrel and the swivel housing and preventing relative axial translation between the mandrel and the swivel housing; and (d) one or more support rings circumferentially mounted on the swivel housing, wherein the one or more support rings:

fit sealingly with the swivel housing to contain fluid pressure within the cement swivel assembly;

have one or more ports for the connection of fluid flow lines from a drilling rig; and have one or more fluid flow channels through which cement slurry and other fluids can be transferred between the connected flow lines to the one or more swivel housing side ports.

25. A cementing head apparatus as in claim 24, wherein at least one of the one or more support rings is designed to structurally reinforce the swivel housing.

26. A cementing head apparatus as in claim 1, wherein the paddle actuation means also enables selectively progressive movement of the one or more paddles from the launch position toward the hold position.

* * * * *